US012736064B2

(12) United States Patent
Suzuki et al.

(10) Patent No.: US 12,736,064 B2
(45) Date of Patent: Sep. 15, 2026

(54) AIRFLOW CONTROL APPARATUS, AIRFLOW CONTROL SYSTEM, AND AIRFLOW CONTROL METHOD

(71) Applicant: SONY GROUP CORPORATION, Tokyo (JP)

(72) Inventors: Hiroshi Suzuki, Tokyo (JP); Emiri Sakiyama, Tokyo (JP); Ryo Yokoyama, Tokyo (JP); Koji Shimotoku, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 0 days.

(21) Appl. No.: 19/104,357

(22) PCT Filed: Aug. 1, 2023

(86) PCT No.: PCT/JP2023/028046
§ 371 (c)(1),
(2) Date: Feb. 17, 2025

(87) PCT Pub. No.: WO2024/043013
PCT Pub. Date: Feb. 29, 2024

(65) Prior Publication Data

US 2026/0104060 A1 Apr. 16, 2026

(30) Foreign Application Priority Data

Aug. 24, 2022 (JP) ..... 2022-133243
Mar. 13, 2023 (JP) ..... 2023-038805

(51) Int. Cl.
*F04D 29/56* (2006.01)
*F04D 25/08* (2006.01)

(52) U.S. Cl.
CPC ..... *F04D 29/563* (2013.01); *F04D 25/08* (2013.01)

(58) Field of Classification Search
CPC ..... F24F 13/078; F24F 11/79; F24F 13/08; F24F 13/06; F04D 29/56; F04D 29/563;
(Continued)

(56) References Cited

U.S. PATENT DOCUMENTS 6,607,365 B1 * 8/2003 Kabasawa ..... F04D 27/0253 417/423.4
8,403,635 B2 * 3/2013 Tabata ..... F04D 29/462 415/211.2
(Continued)

FOREIGN PATENT DOCUMENTS

JP 53-3688 B1 2/1978
JP 1980030929 U1 2/1980
(Continued)

OTHER PUBLICATIONS

International Search Report and Written Opinion of PCT Application No. PCT/JP2023/028046, issued on Oct. 24, 2023, 08 pages of ISRWO.

*Primary Examiner* — Justin D Seabe
(74) *Attorney, Agent, or Firm* — CHIP LAW GROUP

(57) ABSTRACT

An airflow control apparatus according to an embodiment of the present technology includes a first frame, a second frame, and a rectifying plate. The first frame is located about the center of rotation and includes a through-hole. The second frame is located, about the center of rotation, on an outer circumference side relative to the first frame. The rectifying plate is flexible, has one end fixed to the center of rotation and another end fixed to the second frame, passes through the through-hole, and changes an amount of deflection of a portion between the through-hole and the center of rotation according to a change in a length of the portion by relative rotation of the first frame and the second frame about the center of rotation.

19 Claims, 36 Drawing Sheets

(58) Field of Classification Search
CPC ..... F04D 29/305; F04D 29/444; F04D 29/46; F04D 29/462
See application file for complete search history.

(56) References Cited

U.S. PATENT DOCUMENTS

| | | | | |
|---|---|---|---|---|
| 9,951,791 | B2 * | 4/2018 | Jung | F04D 29/563 |
| 11,988,222 | B2 * | 5/2024 | Li | F04D 1/04 |

FOREIGN PATENT DOCUMENTS

| | | | |
|---|---|---|---|
| JP | 1984047394 | U1 | 3/1984 |
| JP | 2015042868 | A | 3/2015 |
| JP | 2016070110 | A | 5/2016 |
| JP | 2016151173 | A | 8/2016 |
| WO | 2023/032458 | A1 | 3/2023 |

* cited by examiner

AIRFLOW CONTROL APPARATUS, AIRFLOW CONTROL SYSTEM, AND AIRFLOW CONTROL METHOD

CROSS-REFERENCE TO RELATED APPLICATIONS

This application is a U.S. National Phase of International Patent Application No. PCT/JP2023/028046 filed on Aug. 1, 2023, which claims priority benefit of Japanese Patent Application No. JP 2022-133243 filed in the Japan Patent Office on Aug. 24, 2022 and Japanese Patent Application No. JP 2023-038805 filed in the Japan Patent Office on Mar. 13, 2023. Each of the above-referenced applications is hereby incorporated herein by reference in its entirety.

TECHNICAL FIELD

The present technology relates to an airflow control apparatus, an airflow control system, and an airflow control method that generate airflow.

BACKGROUND ART

Airflow is used in some cases in order to enhance realistic sensations of audiovisual content. In general, airflow is generated by airflow generators using rotary blades or compressors, and some airflow generators are capable of changing the degree of diffusion or convergence of the airflow. Changing the degree of diffusion or convergence of the airflow can control the range of reach of the airflow, and if its controllability is high, it can be said that the spatial resolution of the airflow is excellent. For example, Patent Literatures 1 to 3 disclose airflow generators each including rotary blades and capable of changing the degree of diffusion or convergence of airflow.

Patent Literature 1 discloses a blower including an axial flow fan and rectifying blades and capable of changing the degree of diffusion or convergence of airflow by changing the position of the rectifying blades. Additionally, Patent Literature 2 discloses a blower including an axial flow fan and rectifying blades and capable of changing the degree of diffusion or convergence of airflow by changing the angle of the rectifying blades. Further, Patent Literature 3 discloses an electric fan including a fan and a front guard and capable of changing the degree of diffusion or convergence of airflow by detaching the front guard and turning it inside out to be attached.

CITATION LIST

Patent Literature

Patent Literature 1: Japanese Patent Application Laid-open No. 2016-070110

Patent Literature 2: Japanese Patent Application Laid-open No. 2016-151173

Patent Literature 3: Japanese Patent Application Laid-open No. 2015-042868

DISCLOSURE OF INVENTION

Technical Problem

However, the configurations as described in Patent Literatures 1 to 3 do not provide a sufficient range of control over the degree of diffusion or convergence of airflow, and the spatial resolution of the airflow is restricted.

In view of the circumstances as described above, it is an object of the present technology to provide an airflow control apparatus, an airflow control system, and an airflow control method that are capable of achieving high spatial resolution of airflow.

Solution to Problem

In order to achieve the above-mentioned object, an airflow control apparatus according to an embodiment of the present technology includes a first frame, a second frame, and a rectifying plate.

The first frame is located about the center of rotation and includes a through-hole.

The second frame is located, about the center of rotation, on an outer circumference side relative to the first frame.

The rectifying plate is flexible, has one end fixed to the center of rotation and another end fixed to the second frame, passes through the through-hole, and changes an amount of deflection of a portion between the through-hole and the center of rotation according to a change in a length of the portion by relative rotation of the first frame and the second frame about the center of rotation.

The first frame may have a cylindrical shape that is centered at the center of rotation, and the second frame may have a cylindrical shape that is centered at the center of rotation and has an inner diameter larger than an outer diameter of the first frame.

The through-hole may have a slit shape with a direction parallel to the center of rotation as a longitudinal direction, and the rectifying plate may be parallel to the center of rotation.

The through-hole may have a slit shape with one direction as a longitudinal direction, the longitudinal direction changing between a direction parallel to the center of rotation and a direction inclined relative to the direction parallel to the center of rotation by the relative rotation, and the rectifying plate may change between a state parallel to the center of rotation and a state inclined relative to the center of rotation by the relative rotation.

The airflow control apparatus may further include a fan that is capable of changing a pitch angle of a rotary blade and delivers airflow to the rectifying plate.

The fan may include a rotary drive source, a rotary shaft that connects the rotary blade and the rotary drive source and rotates by the rotary drive source to rotate the rotary blade, a pitch drive source, and a pitch angle changing mechanism that transmits power of the pitch drive source in a direction parallel to an axial direction of the rotary shaft separately from rotation of the rotary shaft, and changes the pitch angle of the rotary blade.

The pitch angle changing mechanism may include a handle portion that changes the pitch angle of the rotary blade by rotation, and a sliding shaft that slides in a direction parallel to the rotary shaft by drive of the pitch drive source to rotate the handle portion.

The airflow control apparatus may further include a nozzle that is capable of changing a nozzle diameter, airflow having passed through the rectifying plate flowing into the nozzle.

The airflow control apparatus may further include: a fan that is capable of changing a pitch angle of a rotary blade and delivers airflow to the rectifying plate; and a nozzle that is capable of changing a nozzle diameter, airflow having passed through the rectifying plate flowing into the nozzle.

In order to achieve the above-mentioned object, an airflow control system according to an embodiment of the present technology includes an airflow control apparatus and a controller.

The airflow control apparatus includes a first frame that is located about the center of rotation and includes a through-hole, a second frame that is located, about the center of rotation, on an outer circumference side relative to the first frame, and a rectifying plate that is flexible, has one end fixed to the center of rotation and another end fixed to the second frame, passes through the through-hole, and changes an amount of deflection of a portion between the through-hole and the center of rotation according to a change in a length of the portion by relative rotation of the first frame and the second frame about the center of rotation.

The controller controls the rectifying plate to define relative rotation angles of the first frame and the second frame about the center of rotation.

The airflow control apparatus may further include a nozzle that is capable of changing a nozzle diameter, airflow having passed through the rectifying plate flowing into the nozzle, and the controller may further control the nozzle to define the nozzle diameter.

The controller may change a degree of diffusion and convergence of the airflow delivered from the airflow control apparatus by controlling the rectifying plate and the nozzle.

The controller may control the rectifying plate and the nozzle to present airflow simulated in a space in a virtual space to a user.

The airflow control apparatus may further include a fan that is capable of changing a pitch angle of a rotary blade and delivers airflow to the rectifying plate, and the controller may further control the fan to define the pitch angle.

The controller may change a degree of diffusion and convergence and a flow velocity of the airflow delivered from the airflow control apparatus by controlling the rectifying plate and the fan.

The controller may control the rectifying plate and the fan to present airflow simulated in a space in a virtual space to a user.

The airflow control apparatus may further include a nozzle that is capable of changing a nozzle diameter, airflow having passed through the rectifying plate flowing into the nozzle, and a fan that is capable of changing a pitch angle of a rotary blade and delivers airflow to the rectifying plate, and the controller may change a degree of diffusion and convergence and a flow velocity of the airflow delivered from the airflow control apparatus by controlling the rectifying plate, the nozzle, and the fan.

The controller may control the rectifying plate, the nozzle, and the fan to present airflow simulated in a space in a virtual space to a user.

In order to achieve the above-mentioned object, an airflow control method according to an embodiment of the present technology includes: controlling a rectifying plate of an airflow control apparatus, the airflow control apparatus including a first frame that is located about the center of rotation and includes a through-hole, a second frame that is located, about the center of rotation, on an outer circumference side relative to the first frame, and the rectifying plate that is flexible, has one end fixed to the center of rotation and another end fixed to the second frame, passes through the through-hole, and changes an amount of deflection of a portion between the through-hole and the center of rotation according to a change in a length of the portion by relative rotation of the first frame and the second frame about the center of rotation; and defining relative rotation angles of the first frame and the second frame about the center of rotation.

In order to achieve the above-mentioned object, an airflow control method according to an embodiment of the present technology includes controlling an airflow control apparatus that generates airflow, on the basis of a flow velocity and a range of reach of airflow to be presented to a user.

MODE(S) FOR CARRYING OUT THE INVENTION

[Configuration of Airflow Control Apparatus]

Figure 1:
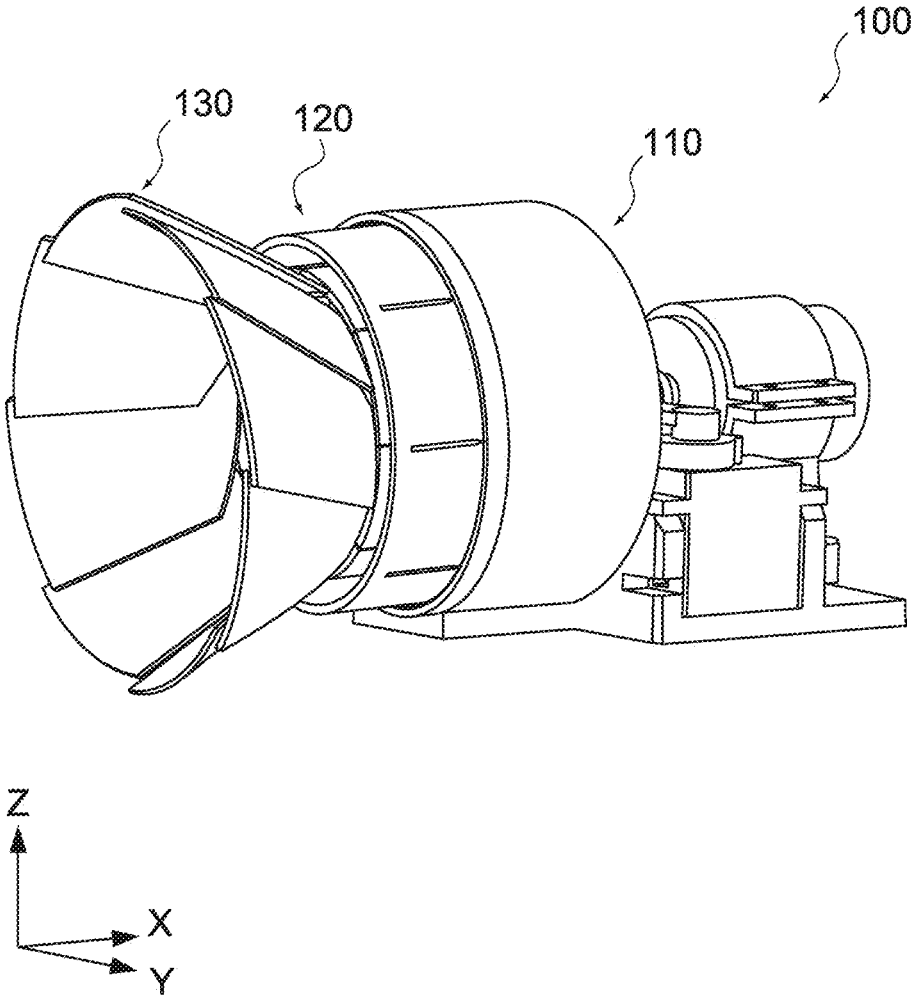
FIG. 1 is a perspective view of an airflow control apparatus according to an embodiment of the present technology.
Figure 2:
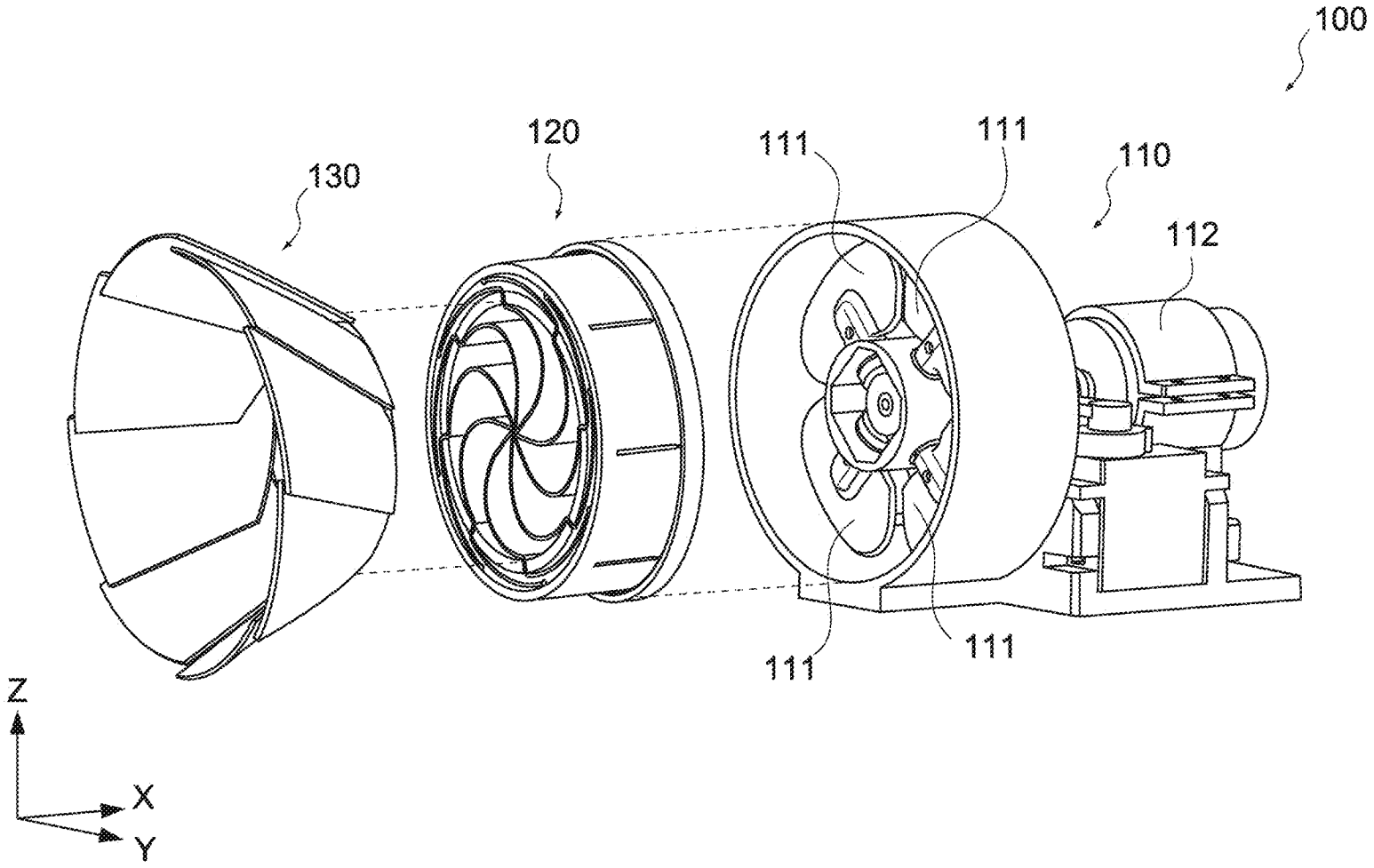
FIG. 2 is an exploded cross-sectional view of the airflow control apparatus.

An airflow control apparatus according to an embodiment of the present technology will be described. FIG. 1 is a perspective view of an airflow control apparatus 100 according to this embodiment, and FIG. 2 is an exploded perspective view of the airflow control apparatus. As shown in those figures, the airflow control apparatus 100 includes a fan 110, a rectifying plate unit 120, and a nozzle 130.

The fan 110 delivers airflow toward the rectifying plate unit 120. The fan 110 includes rotary blades 111 and a rotary drive source 112 as shown in FIG. 2, and the rotary blades 111 are rotated by the rotary drive source 112 to generate airflow. The gas that becomes the airflow is, for example, air, but it may be other gases. The fan 110 can change the pitch angle of the rotary blades 111, the details of which will be described later.

Figure 3:
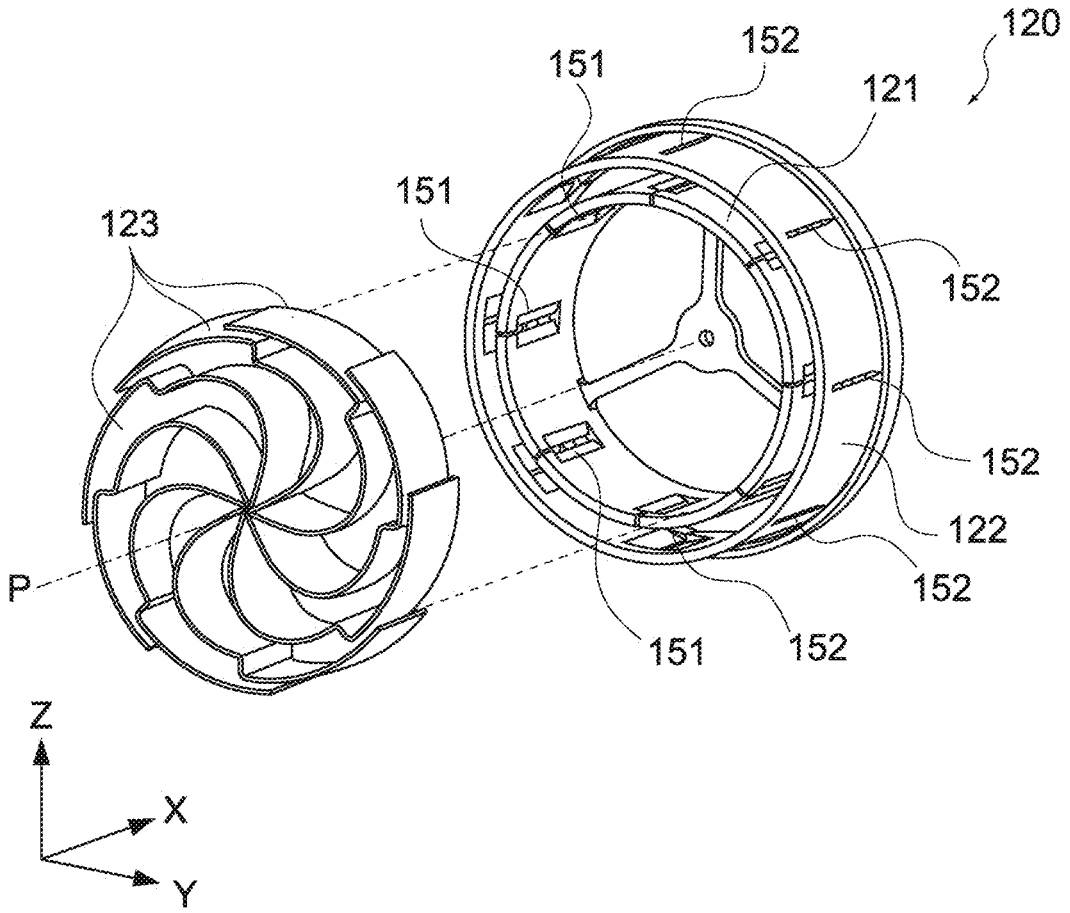
FIG. 3 is an exploded perspective view of a rectifying plate unit included in the airflow control apparatus.
Figure 4:
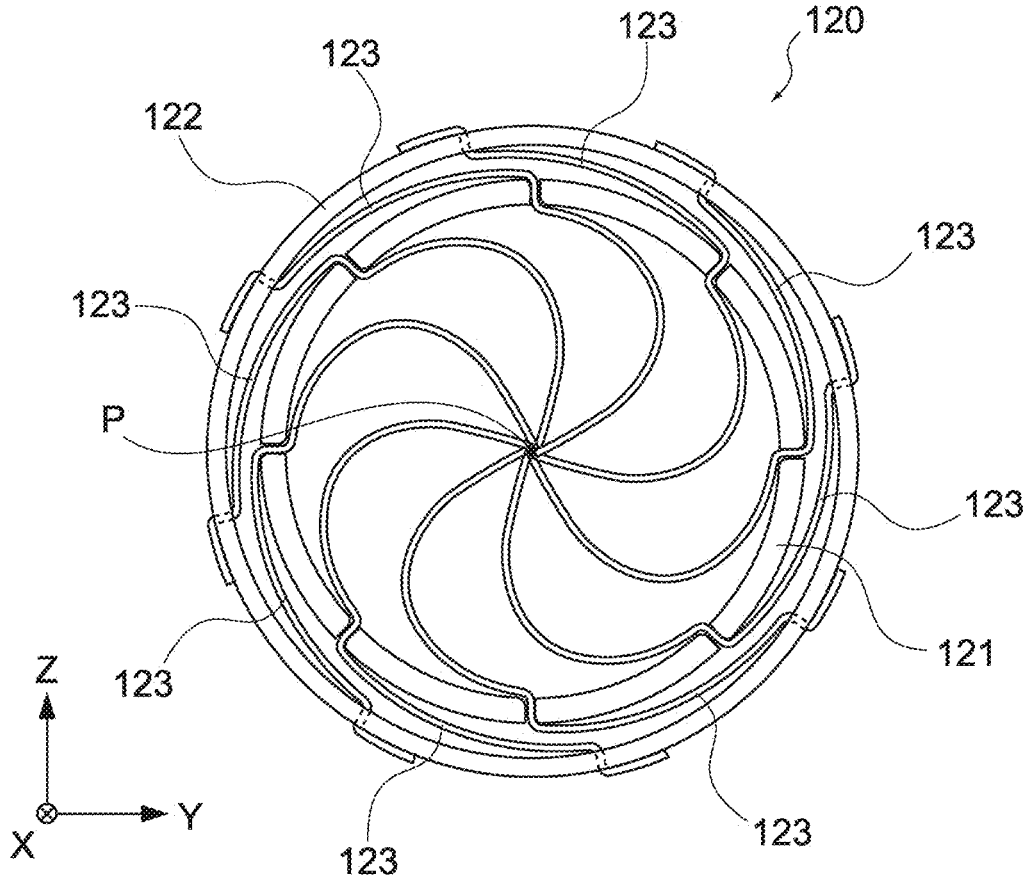
FIG. 4 is a plan view of the rectifying plate unit.
Figure 5:
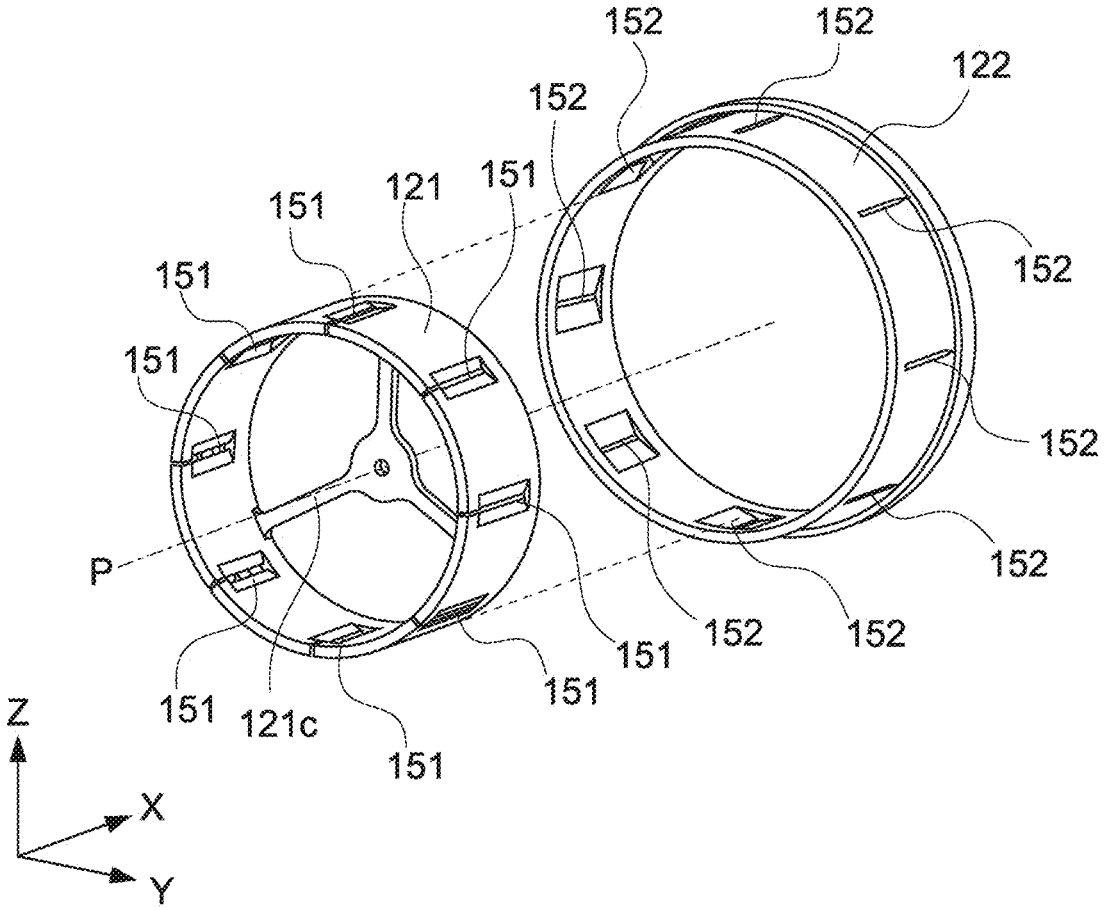
FIG. 5 is an exploded perspective view of a first frame and a second frame of the rectifying plate unit.
Figure 6:
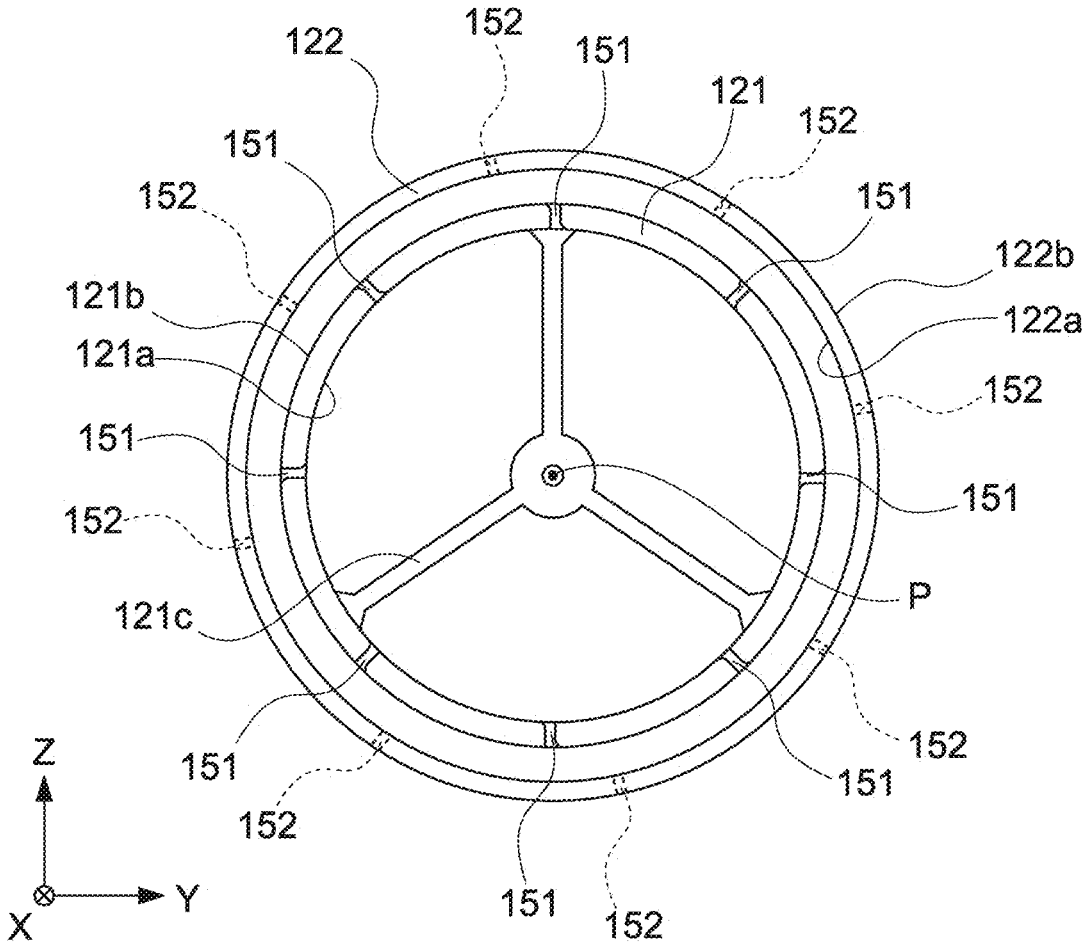
FIG. 6 is a plan view of the first frame and the second frame.

The rectifying plate unit 120 rectifies the airflow delivered from the fan 110. FIG. 3 is an exploded perspective view of the rectifying plate unit 120, and FIG. 4 is a plan view of the rectifying plate unit 120. FIG. 5 is an exploded perspective view of a partial configuration of the rectifying plate unit 120, and FIG. 6 is a plan view of a partial configuration of the rectifying plate unit 120. As shown in FIGS. 3 and 4, the rectifying plate unit 120 includes a first frame 121, a second frame 122, and rectifying plates 123. FIGS. 3 to 6 show the center of rotation P, and the extending direction of the center of rotation P is defined as an X direction in each figure.

As shown in FIG. 6, the first frame 121 is located on the inner circumference side of the second frame 122. The first frame 121 has a cylindrical shape centered at the center of rotation P. The first frame 121 can have a circular cylindrical shape as shown in FIG. 5, but it can also have other cylindrical shapes, such as a square cylindrical shape. As shown in FIG. 6, the surface of the first frame 121 on the center of rotation P side is an inner circumferential surface 121*a*, and the surface opposite to the inner circumferential surface 121*a* is an outer circumferential surface 121*b*. Both the inner circumferential surface 121*a* and the outer circumferential surface 121*b* are parallel to the extending direction of the center of rotation P (X direction). The first frame 121 includes a support portion 121*c* that connects the inner circumferential surface 121*a*.

Figure 7:
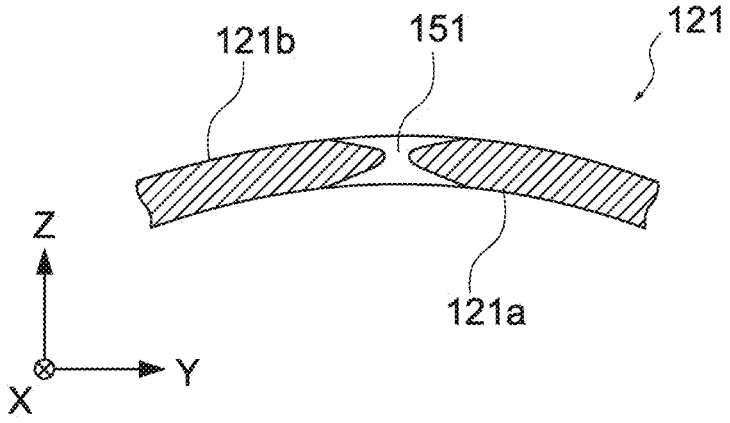
FIG. 7 is a cross-sectional view of a part of the first frame.

As shown in FIG. 5, the first frame 121 includes a plurality of through-holes 151. The through-hole 151 has a slit shape with the direction parallel to the center of rotation P (X direction) as a longitudinal direction. The number of through-holes 151 is not particularly limited, but can be eight, for example. FIG. 7 is a cross-sectional view of the vicinity of the through-hole 151 of the first frame 121. As shown in the figure, the inner circumferential surface 121*a* side and the outer circumferential surface 121*b* side of the through-hole 151 are chamfered.

As shown in FIG. 6, the second frame 122 is located on the outer circumference side of the first frame 121. The second frame 122 has a cylindrical shape centered at the center of rotation P. The second frame 122 can have a circular cylindrical shape as shown in FIG. 5, but it can also have other cylindrical shapes, such as a square cylindrical shape. The inner diameter of the second frame 122 is larger than the outer diameter of the first frame 121, and the second frame 122 is more distant from the center of rotation P than the first frame 121. As shown in FIG. 6, the surface of the second frame 122 on the center of rotation P side is an inner circumferential surface 122*a*, and the surface opposite to the inner circumferential surface 122*a* is an outer circumferential surface 122*b*. The inner circumferential surface 122*a* faces the outer circumferential surface 121*b* of the first frame 121 at a predetermined interval.

Figure 8:
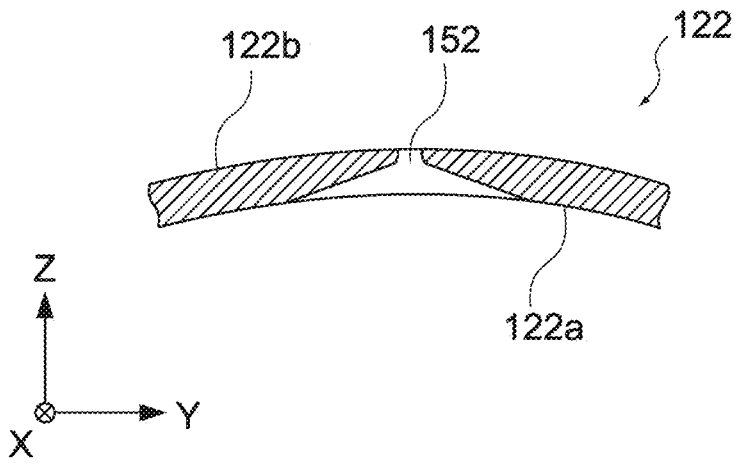
FIG. 8 is a cross-sectional view of a part of the second frame.

As shown in FIG. 5, the second frame 122 includes a plurality of through-holes 152. The through-hole 152 has a slit shape with the direction parallel to the center of rotation P (X direction) as a longitudinal direction. The number of through-holes 152 is the same as that of the through-holes 151. FIG. 8 is a cross-sectional view of the vicinity of the through-hole 152 of the second frame 122. As shown in the figure, the inner circumferential surface 122*a* side of the through-hole 152 is chamfered.

Figure 9:
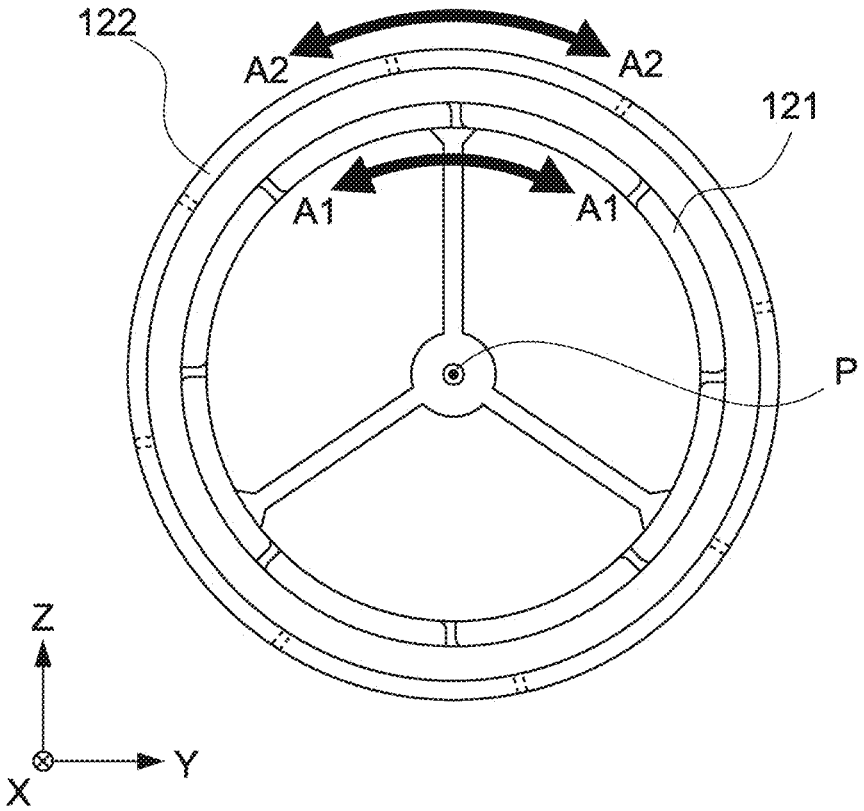
FIG. 9 is a schematic view showing relative rotation of the first frame and the second frame.

The first frame 121 and the second frame 122 rotate relative to each other about the center of rotation P. FIG. 9 is a schematic view showing the rotation of the first frame 121 and the second frame 122. The first frame 121 may rotate about the center of rotation P as indicated by the arrow A1 in FIG. 9, and the second frame 122 may not rotate. Additionally, the second frame 122 may rotate about the center of rotation P as indicated by the arrow A2 in FIG. 9, and the first frame 122 may not rotate. Further, as indicated by the arrows A1 and A2 in FIG. 9, both the first frame 121 and the second frame 122 may rotate about the center of rotation P.

Figure 10:
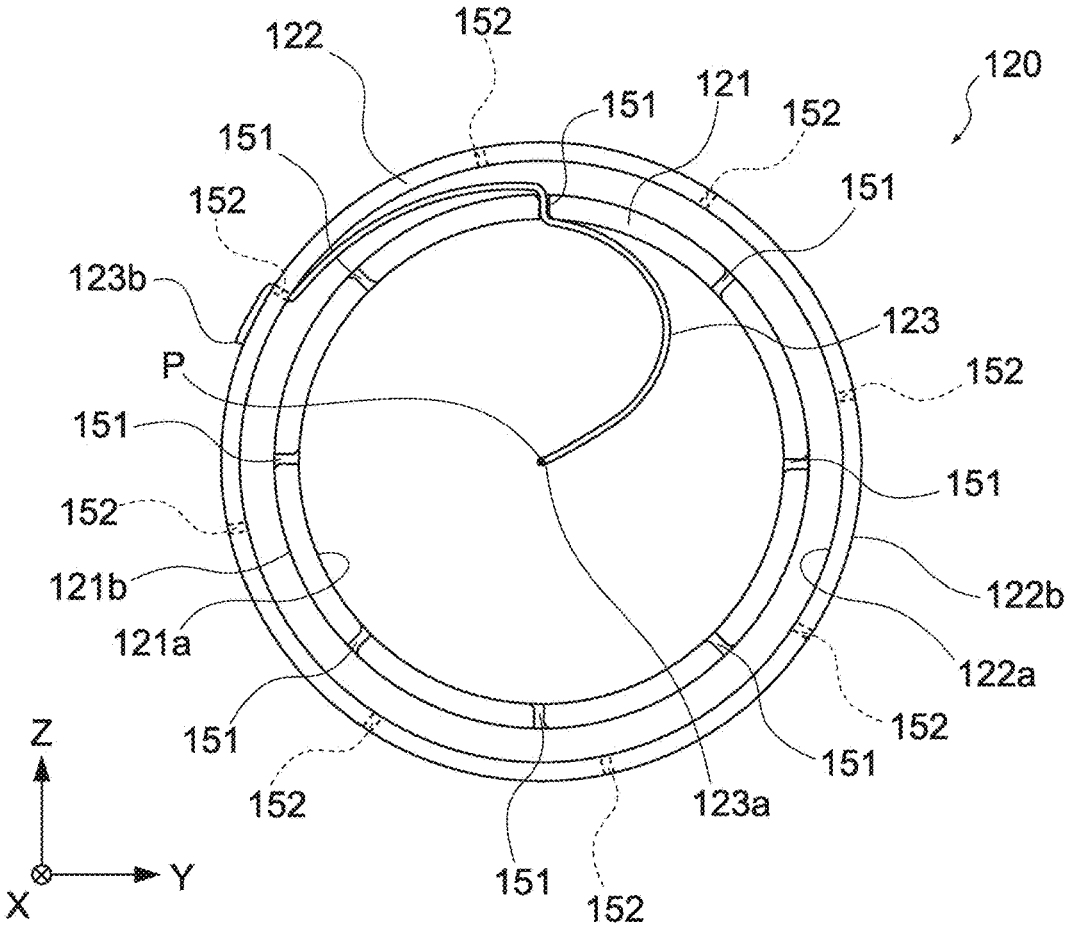
FIG. 10 is a plan view of one rectifying plate of the rectifying plate unit, the first frame, and the second frame.
Figure 11:
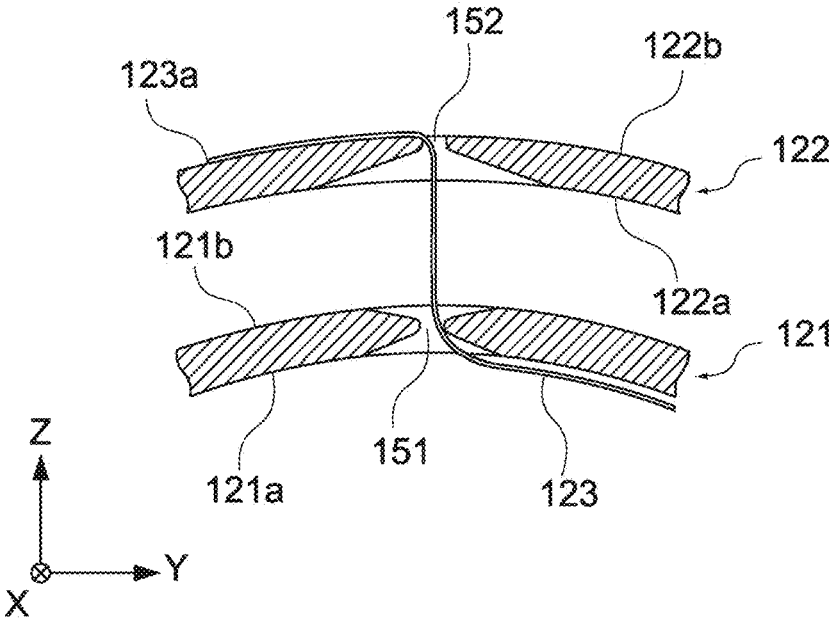
FIG. 11 is a cross-sectional view of a part of the rectifying plate, the first frame, and the second frame.

The rectifying plates 123 are flexible and attached to the first frame 121 and the second frame 122. FIG. 10 is a plan view showing one rectifying plate 123, the first frame 121, and the second frame 122, and FIG. 11 is a cross-sectional view showing the vicinity of the through-hole 151. As shown in those figures, the rectifying plate 123 passes through the through-hole 151 of the first frame 121 from the inner circumferential surface 121*a* side to the outer circumferential surface 121*b* side. The rectifying plate 123 is not fixed to the first frame 121 and can slide within the through-hole 151.

As shown in FIG. 10, one end 123*a* of the rectifying plate 123 is fixed to the center of rotation P. Specifically, the rectifying plate 123 is fixed to the center of rotation P with the one end 123*a* being joined to other rectifying plates 123 at the center of rotation P as shown in FIG. 4. Note that a physical axis may be provided at the center of rotation P, and the one end 123*a* may be joined to that axis to be fixed to the center of rotation P.

Additionally, the other end 123*b* of the rectifying plate 123 is fixed to the second frame 122. Specifically, the rectifying plate 123 further passes through the through-hole 152 of the second frame 122, and the other end 123*b* is joined to the outer circumferential surface 122*b*. Additionally, the rectifying plate 123 may not pass through the through-hole 152 and the other end 123*b* may be joined to the inner circumferential surface 122*a*. In this case, the through-hole 152 may not be provided.

As described above, the center of rotation P and the through-holes 151 extend in the direction parallel to the center of rotation P (X direction), and thus the rectifying plate 123 is also parallel to the same direction (X direction). Although one rectifying plate 123 is shown in FIG. 10, the other rectifying plates 123 each pass through the respective through-holes 151 and are fixed to the center of rotation P and the second frame 122 at both ends in a similar manner (see FIG. 4).

Figure 12:
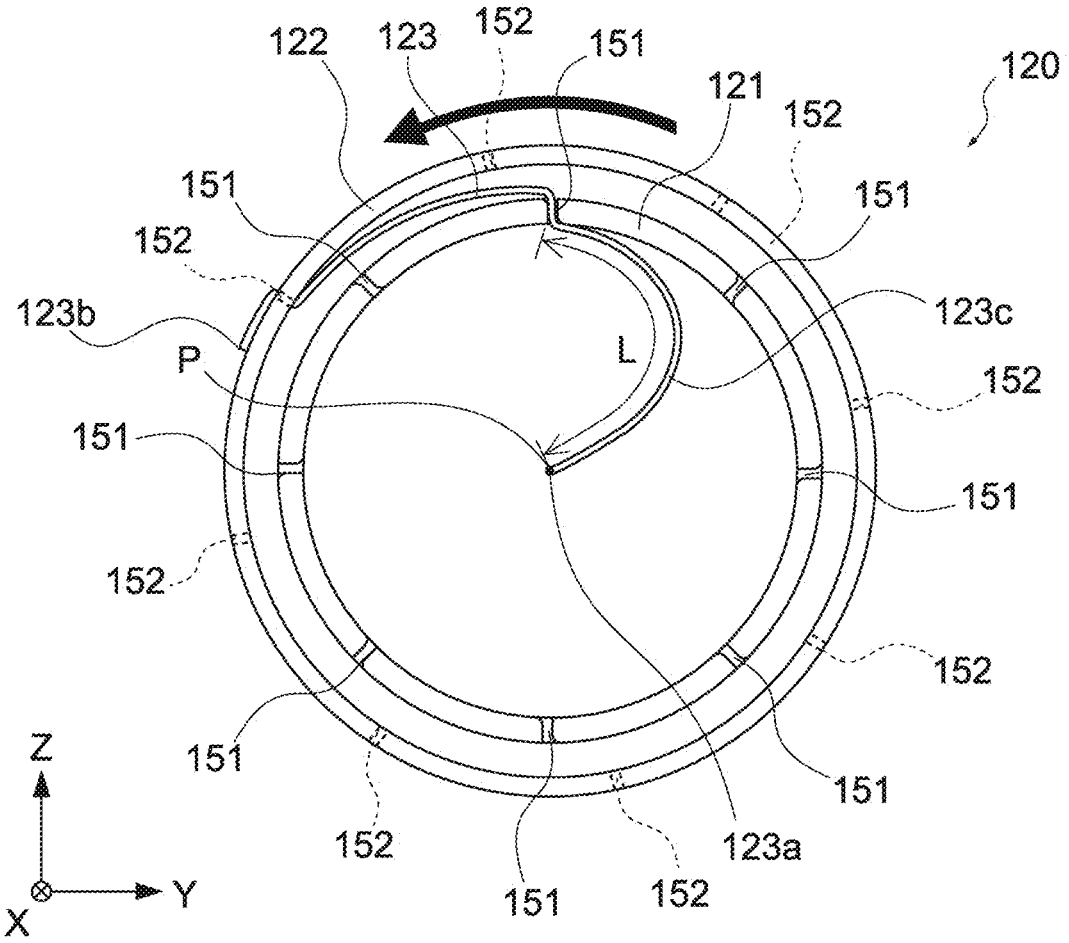
FIG. 12 is a schematic view showing the rotation of the second frame and a change in the amount of deflection of the rectifying plate.
Figure 13:
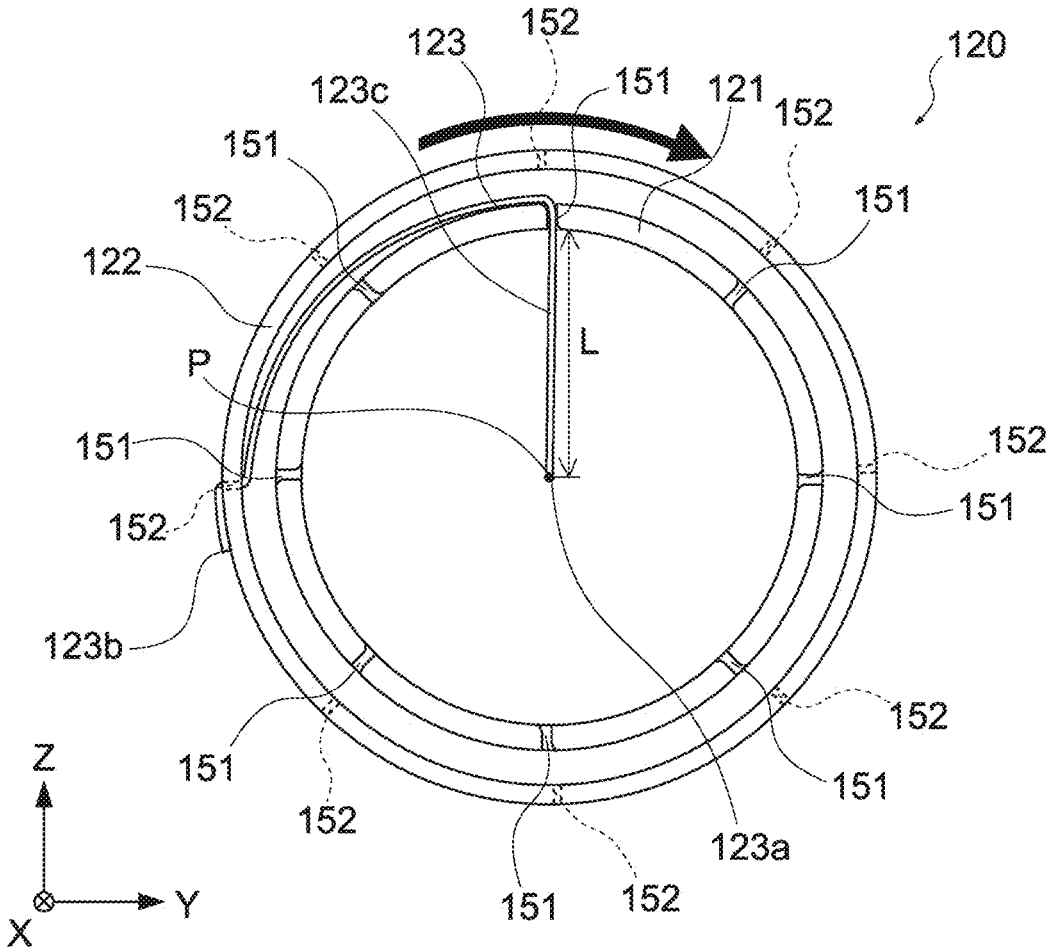
FIG. 13 is a schematic view showing the rotation of the second frame and a change in the amount of deflection of the rectifying plate.
Figure 14:
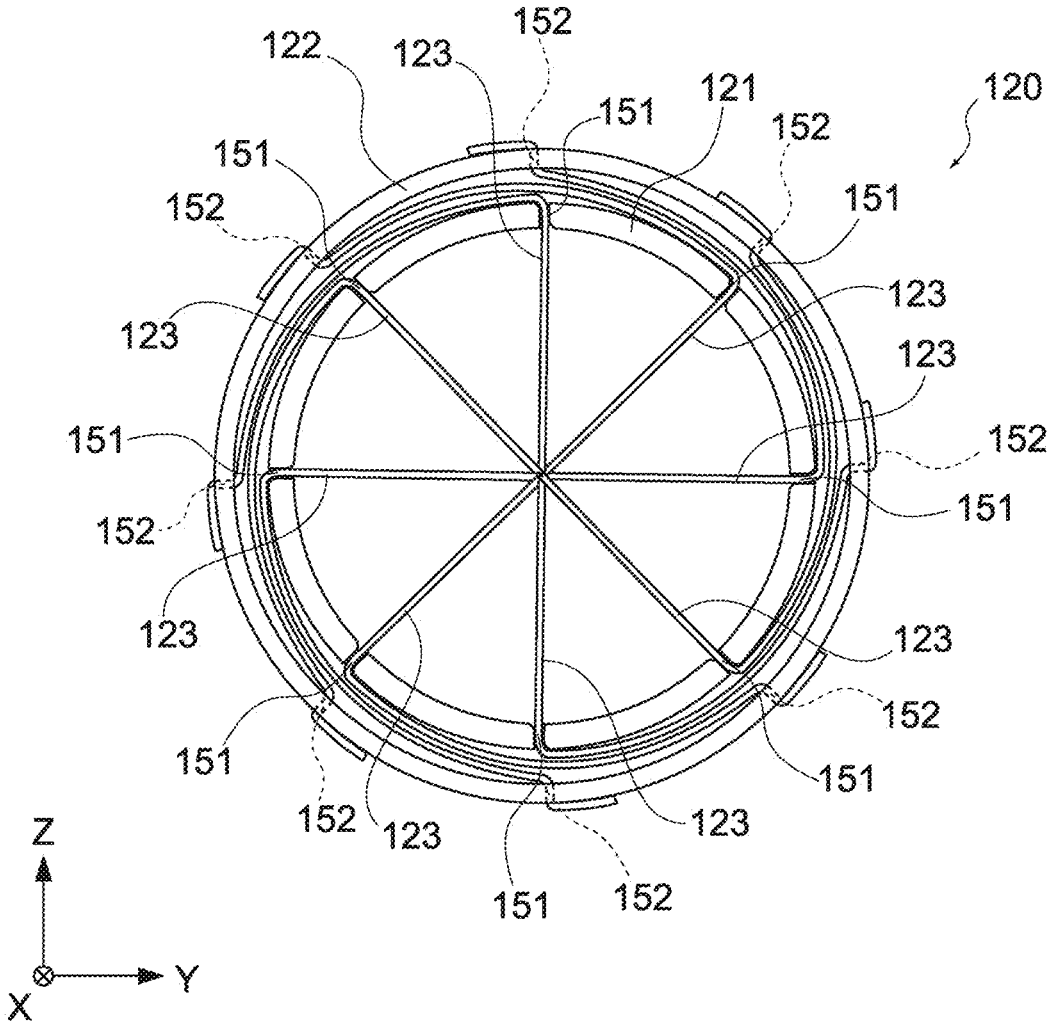
FIG. 14 is a schematic view showing a change in the amount of deflection of the rectifying plate.
Figure 15:
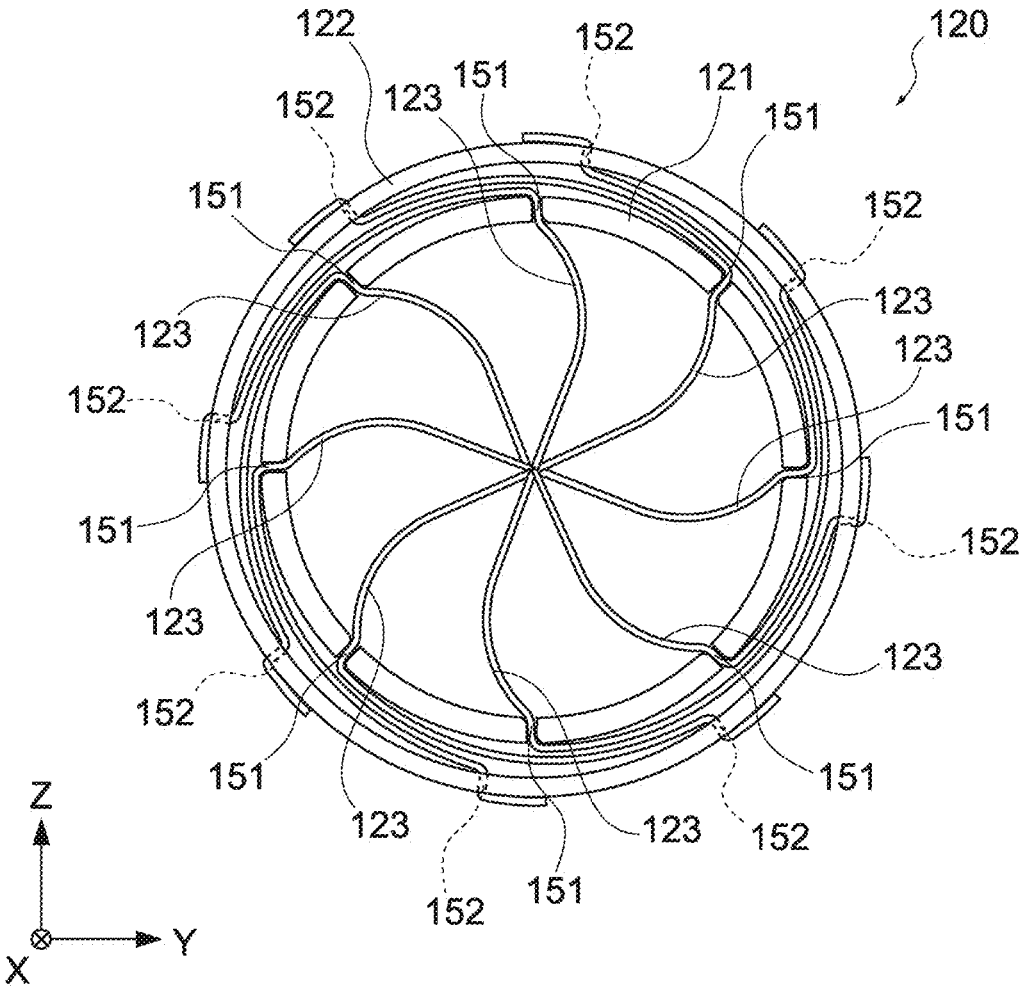
FIG. 15 is a schematic view showing a change in the amount of deflection of the rectifying plate.
Figure 16:
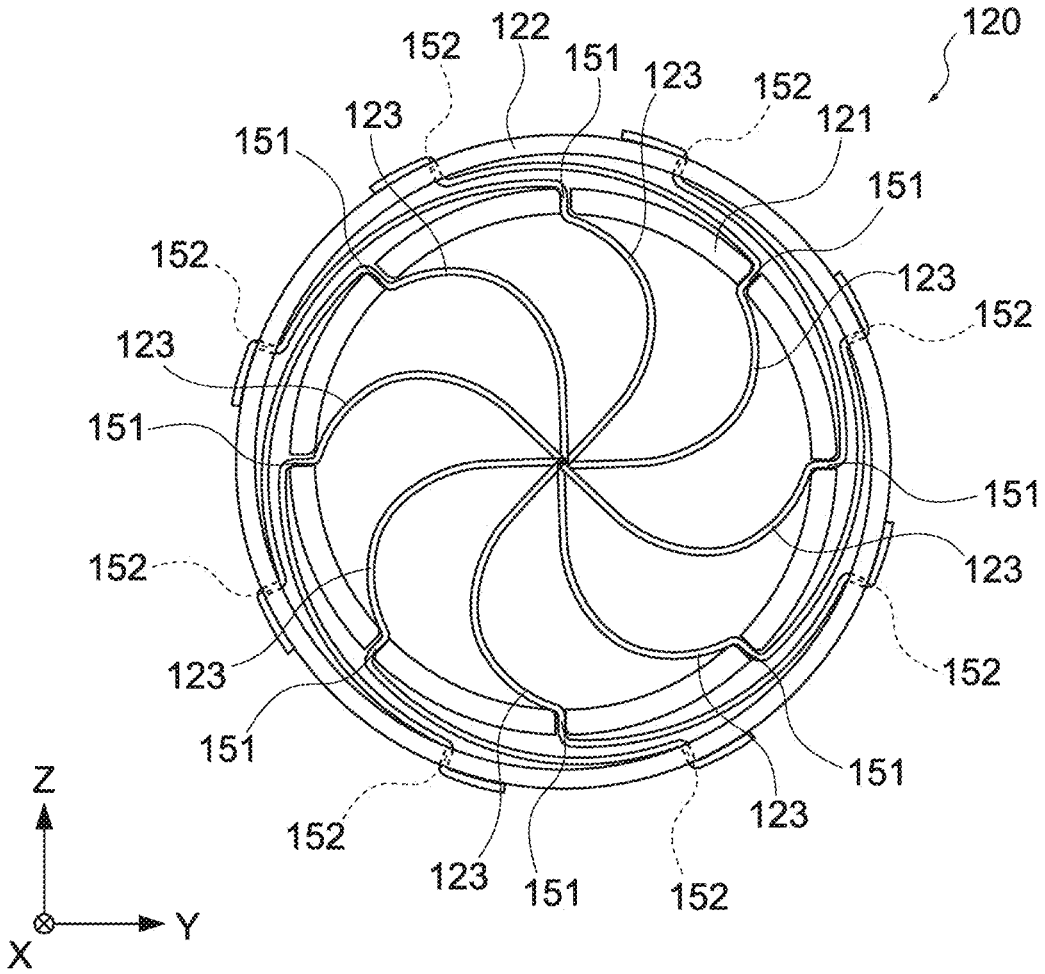
FIG. 16 is a schematic view showing a change in the amount of deflection of the rectifying plate.
Figure 17:
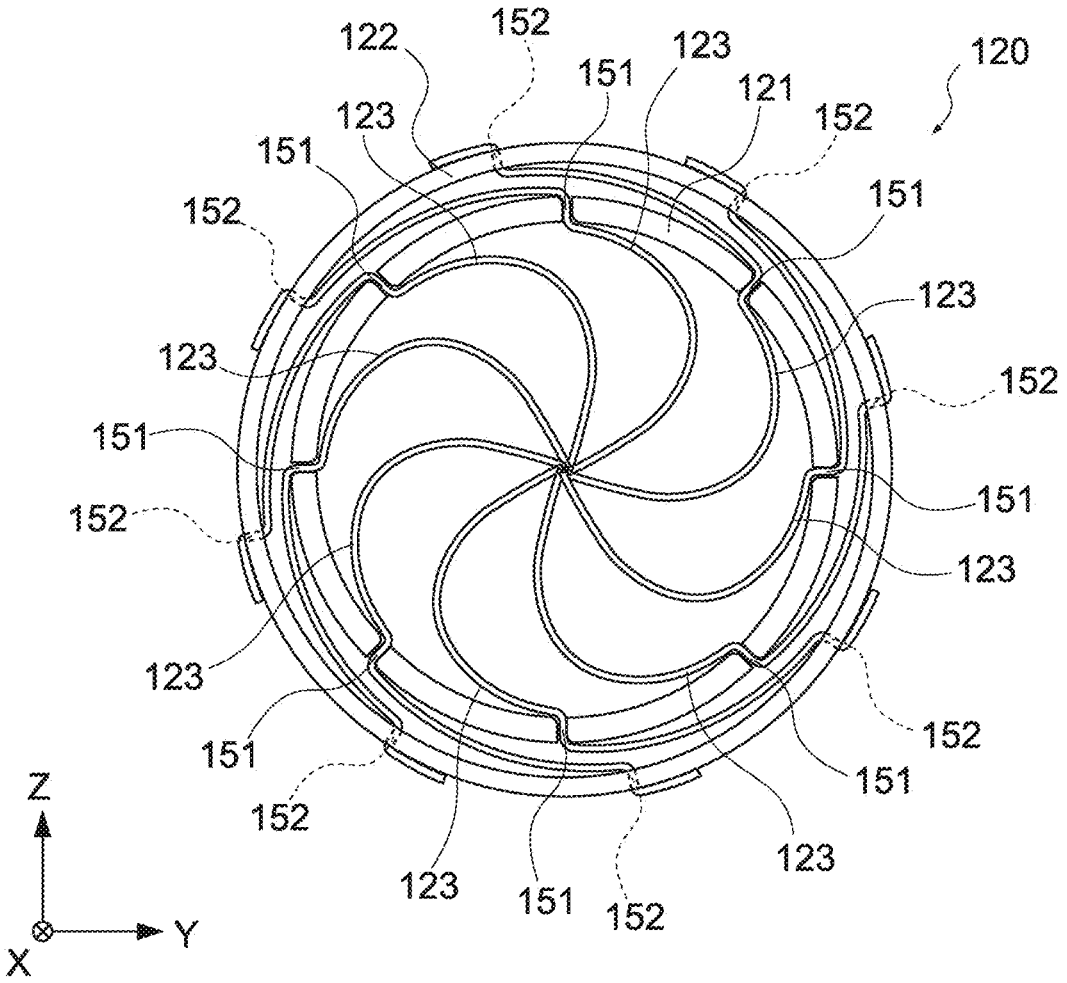
FIG. 17 is a schematic view showing a change in the amount of deflection of the rectifying plate.
Figure 18:
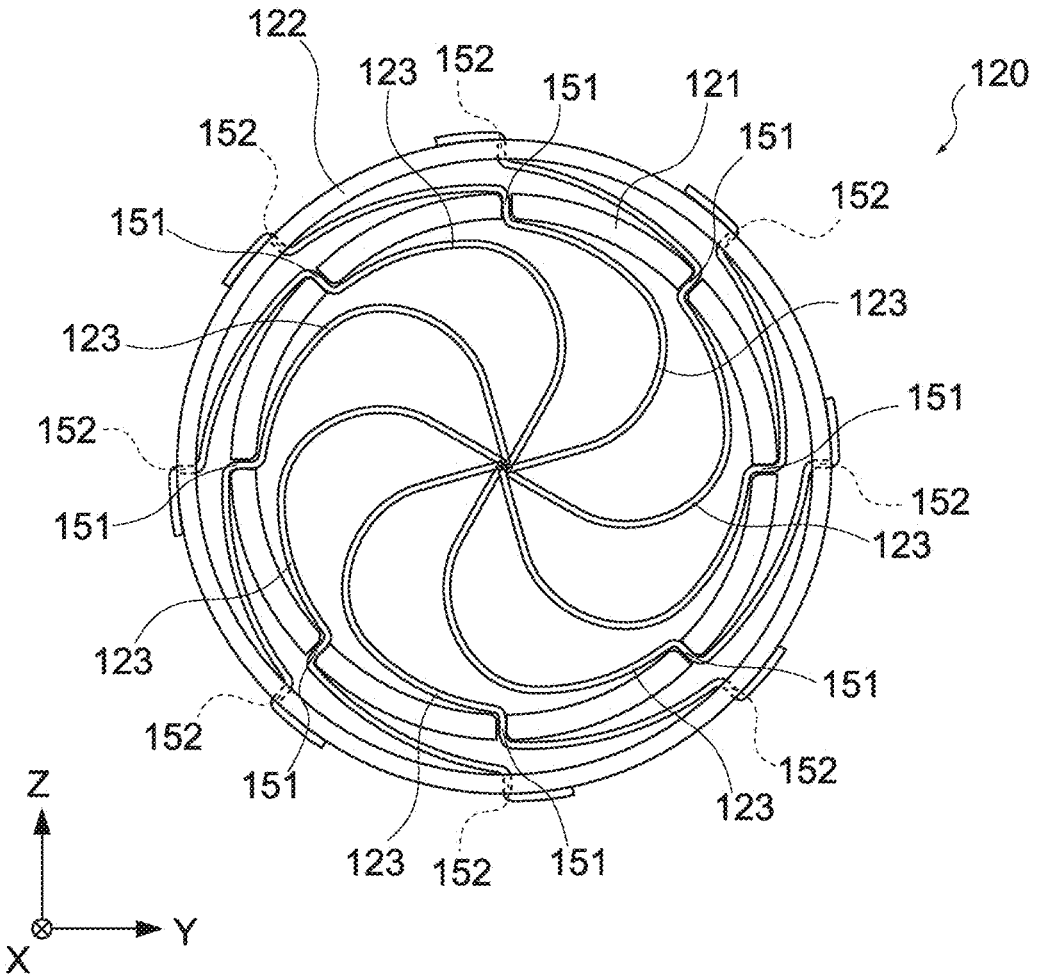
FIG. 18 is a schematic view showing a change in the amount of deflection of the rectifying plate.
Figure 19:
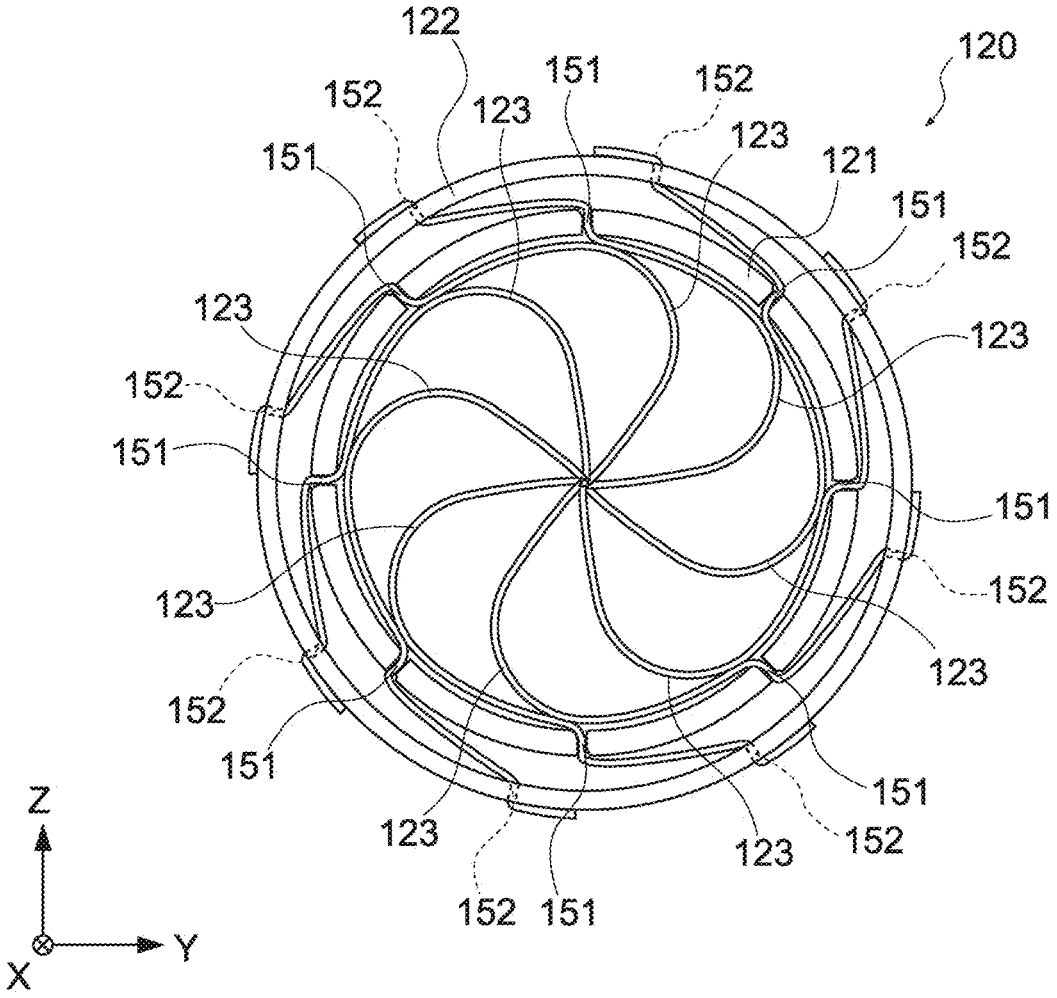
FIG. 19 is a schematic view showing a change in the amount of deflection of the rectifying plate.

The deformation of the rectifying plate 123 will be described. FIGS. 12 and 13 are schematic views showing the deformation of the rectifying plate 123. In those figures, the portion of the rectifying plate 123 between the through-hole 151 and the center of rotation P is referred to as a portion 123*c*. Additionally, the length of the portion 123*c* in those figures is referred to as a length L.

In the state shown in FIG. 12, when the first frame 121 is fixed and the second frame 122 is rotated about the center of rotation P as indicated by the arrow, the other end 123*b* moves away from the through-hole 151 through which the rectifying plate 123 has passed, and the rectifying plate 123 is gradually pulled out of the through-hole 151. Thus, the length L of the portion 123*c* gradually shortens and becomes straight as shown in FIG. 13. Conversely, in the state shown in FIG. 13, when the first frame 121 is fixed and the second frame 122 is rotated about the center of rotation P as indicated by the arrow, the other end 123*b* approaches the through-hole 151 through which the rectifying plate 123 has passed, and the rectifying plate 123 is gradually inserted into the through-hole 151. Thus, the length L of the portion 123*c* gradually becomes longer and becomes curvilinear as shown in FIG. 12.

Since the linear distance between the through-hole 151 and the center of rotation P is always constant, the amount of deflection of the rectifying plate 123 changes in accordance with the length L of the portion 123*c*. FIGS. 14 to 19 are schematic views showing the change in the amount of deflection of each rectifying plate 123 due to the rotation of the second frame 122. As the figure number becomes larger from FIG. 14 to FIG. 19, the angle of rotation of the second frame 122 becomes larger, and the amount of deflection of the rectifying plate 123 also becomes larger. Note that the case where only the second frame 122 is rotated has been described here, but it is sufficient to relatively rotate the first frame 121 and the second frame 122 about the center of rotation P. Rotating only the first frame 121 or both the first frame 121 and the second frame 122 makes it possible to similarly change the amount of deflection of the rectifying plate 123.

As an effect of the deformation of the rectifying plate 123, when the length L of the portion 123*c* becomes longer and the amount of deflection of the rectifying plate 123 becomes larger, i.e., when the rectifying plate 123 becomes curved, the airflow passing through the rectifying plate 123 converges. On the other hand, when the length L of the portion 123*c* becomes shorter and the amount of deflection of the rectifying plate 123 becomes smaller, i.e., when the rectifying plate 123 becomes straight, the airflow passing through the rectifying plate 123 diffuses. Therefore, in the rectifying plate unit 120, the degree of convergence and diffusion of the airflow coming from the fan 110 can be controlled by the relative rotation of the first frame 121 and the second frame 122.

Figure 20:
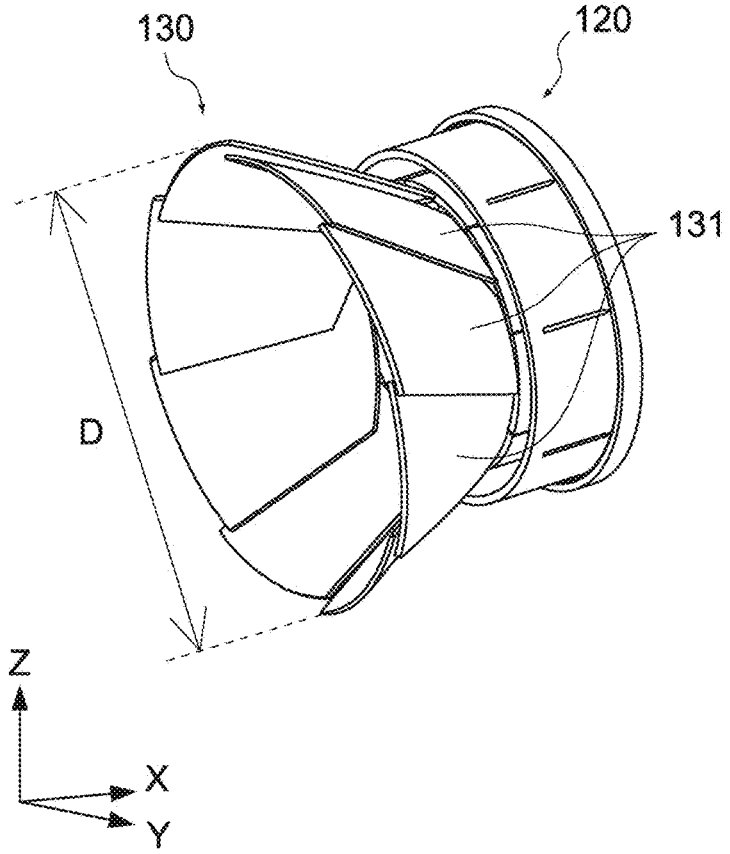
FIG. 20 is a schematic view showing a nozzle diameter of a nozzle included in the airflow control apparatus.
Figure 21:
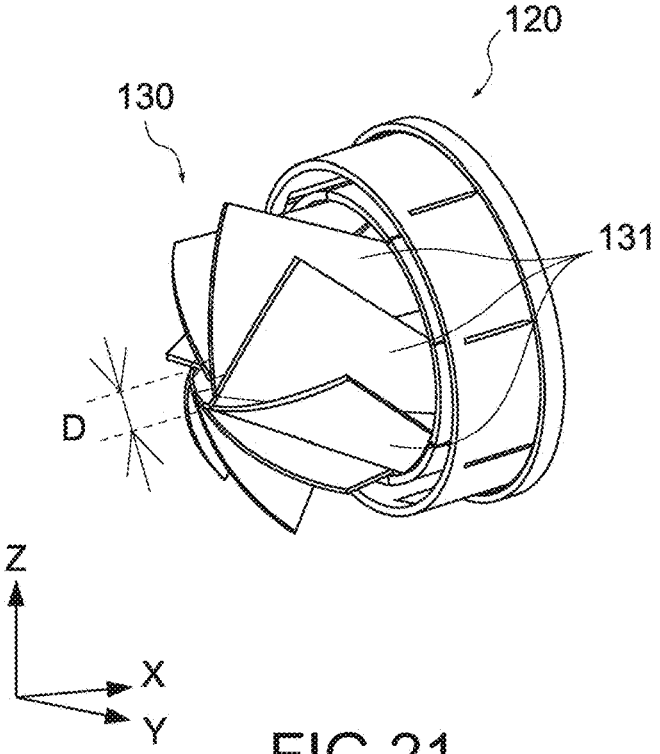
FIG. 21 is a schematic view showing a nozzle diameter of the nozzle included in the airflow control apparatus.

The nozzle 130 controls the degree of convergence and diffusion of the airflow delivered from fan 110 and passing through the rectifying plate unit 120. FIGS. 20 and 21 are perspective views of the nozzle 130. As shown in those figures, the opening diameter on the opposite side of the nozzle 130 from the rectifying plate unit 120 is referred to as a nozzle diameter D. The nozzle 130 is configured by a plurality of plates 131 assembled together. Changing the angle of the plates 131 makes it possible to change the nozzle diameter D as shown in FIGS. 20 and 21. Note that the specific mechanism of the nozzle 130 is not particularly limited as long as it is capable of changing the nozzle diameter D.

[Effects of Airflow Control Apparatus]

Figure 22:
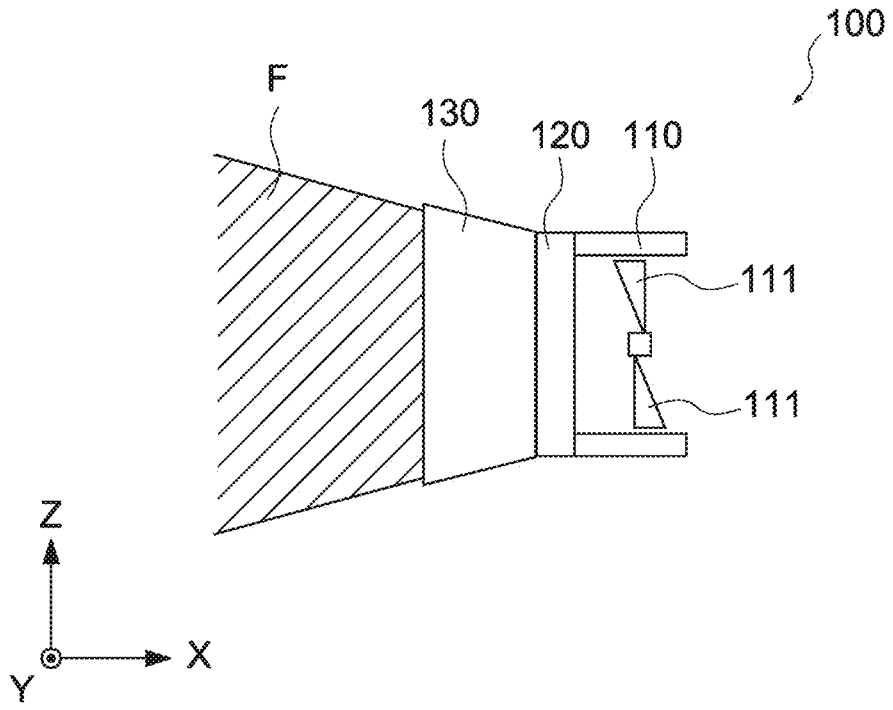
FIG. 22 is a schematic view showing airflow delivered from the airflow control apparatus.
Figure 23:
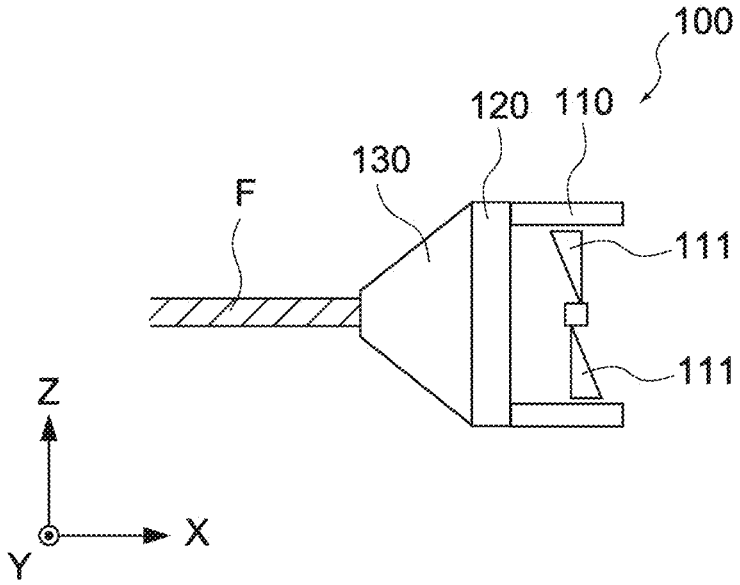
FIG. 23 is a schematic view showing airflow delivered from the airflow control apparatus.

Effects of the airflow control apparatus 100 will be described. FIGS. 22 and 23 are schematic views showing the effects of the airflow control apparatus 100. In the airflow control apparatus 100, when the fan 110 is driven, the airflow generated by the fan 110 passes through the rectifying plate unit 120 and the nozzle 130 and is delivered from the airflow control apparatus 100. The airflow delivered from the airflow control apparatus 100 is indicated as airflow F in FIGS. 22 and 23.

As described above, the airflow control apparatus 100 can control the degree of convergence and diffusion of the airflow by the relative rotation of the first frame 121 and the second frame 122 (see FIGS. 14 to 19) in the rectifying plate unit 120. Thus, in the airflow control apparatus 100, controlling the rectifying plate unit 120 makes it possible to increase the control range of the degree of convergence and diffusion of the airflow F and to enhance the spatial resolution of the airflow F.

Further, the airflow control apparatus 100 can also control the degree of convergence and diffusion of the airflow F by also changing the nozzle diameter D in the nozzle 130 (see FIGS. 20 and 21). Thus, in the airflow control apparatus 100, controlling both the rectifying plate unit 120 and the nozzle 130 makes it possible to further increase the control range of the degree of convergence and diffusion of the airflow F and to further enhance the spatial resolution of the airflow F, as shown in FIGS. 22 and 23.

[Regarding Configuration of Fan]

Figure 24:
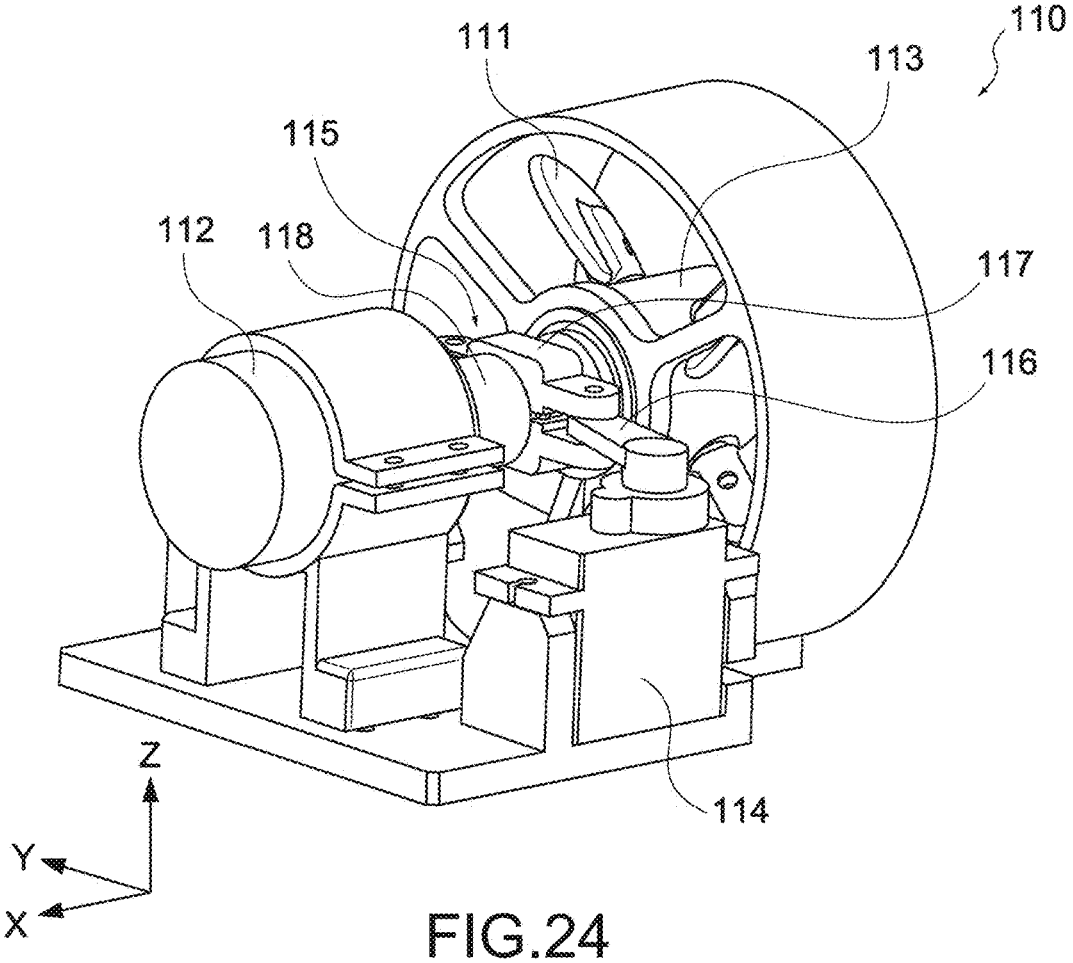
FIG. 24 is a perspective view of a fan included in the airflow control apparatus.
Figure 25:
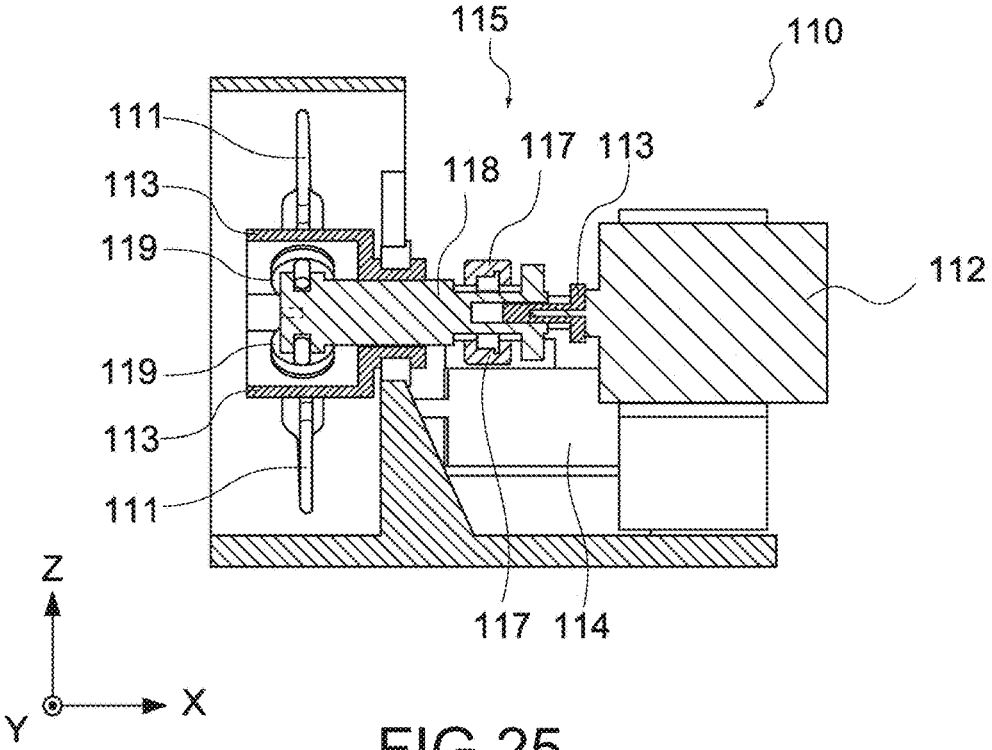
FIG. 25 is a cross-sectional view of the fan.
Figure 26:
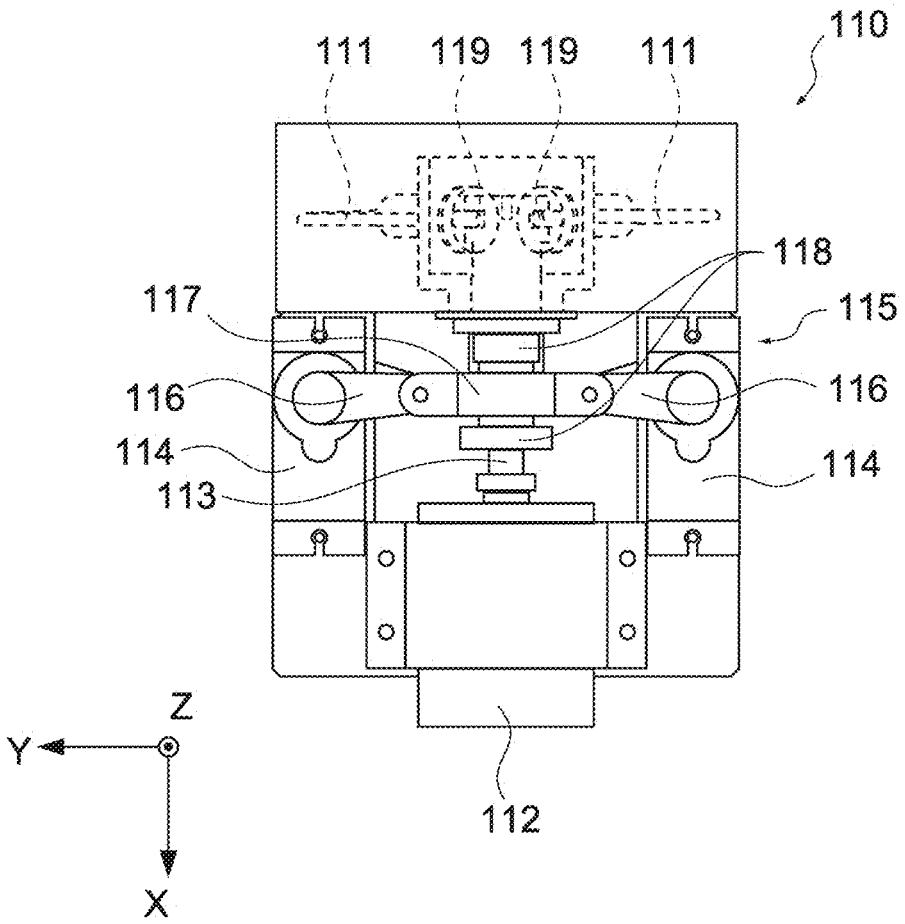
FIG. 26 is a plan view of the fan.
Figure 27:
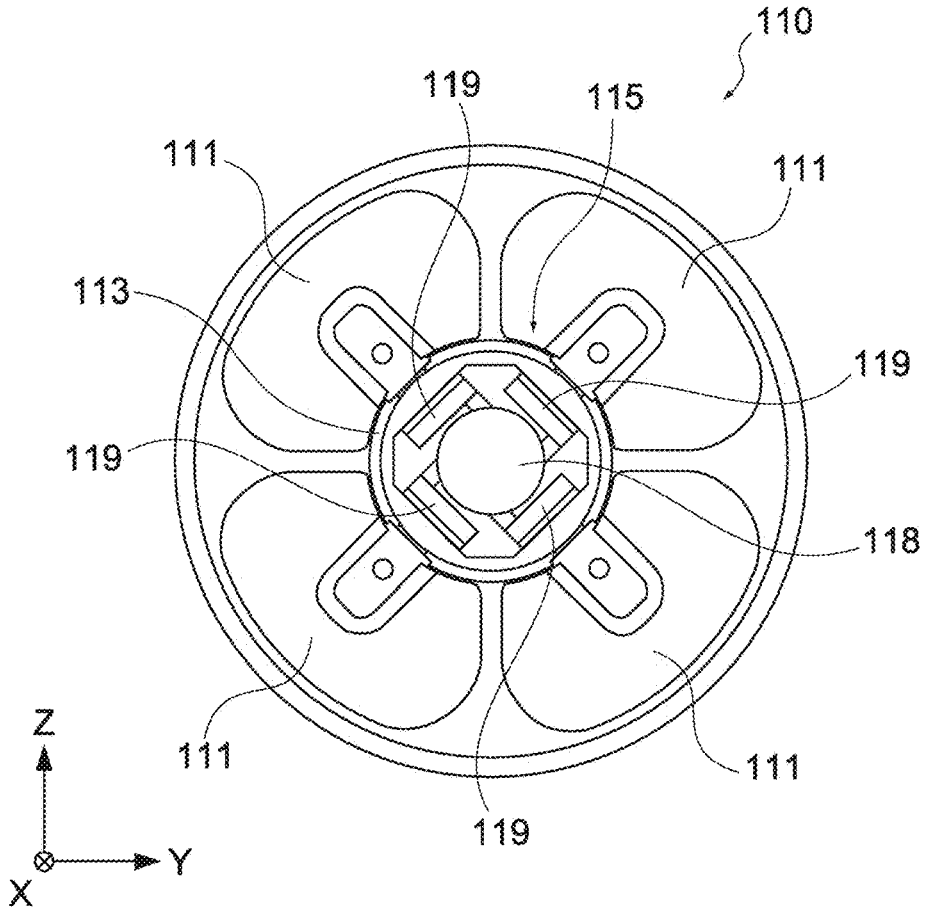
FIG. 27 is a plan view of the fan.

The fan 110 can change a pitch angle. FIG. 24 is a perspective view of the fan 110, and FIG. 25 is a cross-sectional view of the fan 110. FIGS. 26 and 27 are plan views of the fan 110. As shown in those figures, the fan 110 includes the rotary blades 111, the rotary drive source 112, a rotary shaft 113, a pitch drive source 114, and a pitch angle changing mechanism 115.

As shown in FIG. 27, four rotary blades 111 are provided. Each of the rotary blades 111 is connected to the rotary shaft 113 and rotated by the rotary shaft 113. Additionally, the pitch angle of each of the rotary blades 111 is changed by the pitch angle changing mechanism 115. The shape and number of rotary blades 111 are not particularly limited. The rotary drive source 112 generates rotary power. For the rotary drive source 112, a general motor can be used. The rotary shaft 113 is a shaft with the X direction as a longitudinal direction and connects the rotary blades 111 and the rotary drive source 112. The rotary shaft 113 is rotated by the rotary drive source 112 to rotate the rotary blades 111.

As shown in FIG. 26, two pitch drive sources 114 are provided to generate rotary power used to change the pitch angle of the rotary blades 111. For the pitch drive source 114, a servo motor can be used. The pitch angle changing mechanism 115 transmits the power of the pitch drive sources 114 in the direction parallel to the axial direction (X direction) of the rotary shaft 113 separately from the rotation of the rotary shaft 113, and changes the pitch angle of the rotary blades 111.

Specifically, the pitch angle changing mechanism 115 includes an arm 116, a movable portion 117, a sliding shaft 118, and handles 119. In the arm 116, one end is fixed to the output shaft of the pitch drive source 114, and the other end is rotatably connected to the movable portion 117. Thus, the arm 116 moves the movable portion 117 along the axial direction (X direction) of the rotary shaft 113 by rotation of the pitch drive source 114. The movable portion 117 is connected to the arm 116 and the sliding shaft 118 to move along the axial direction (X direction) of the rotary shaft 113 by the arm 116 and cause the sliding shaft 118 to slide in the same direction (X direction).

The sliding shaft 118 rotates together with the rotary shaft 113 and slides along the axial direction (X direction) of the rotary shaft 113 by the movable portion 117. A bearing is provided between the movable portion 117 and the sliding shaft 118 to separate the rotation of the sliding shaft 118 from the movement thereof by the movable portion 117. One handle 119 is provided for each rotary blade 111.

Figure 28:
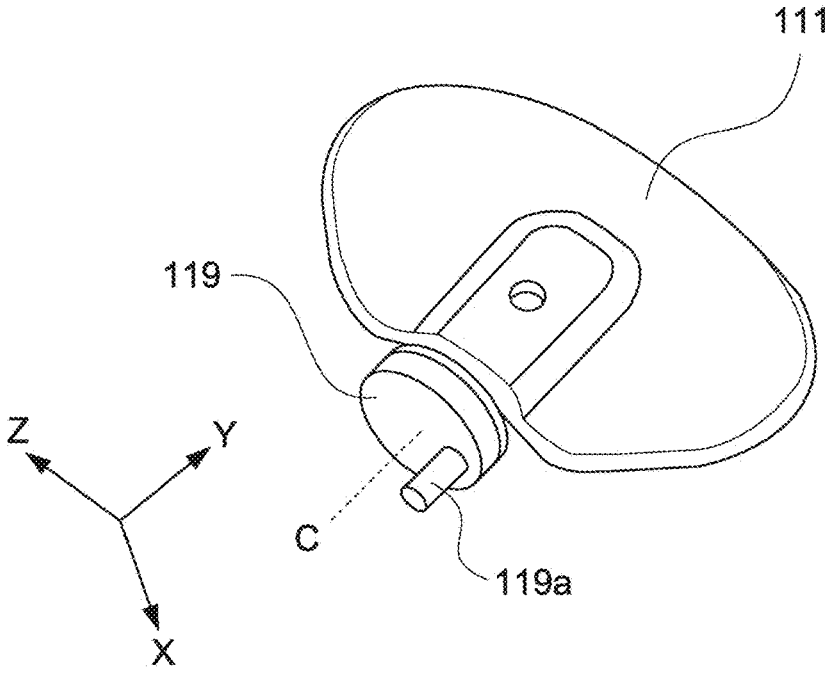
FIG. 28 is a perspective view of a rotary blade and a handle included in the fan.
Figure 29:
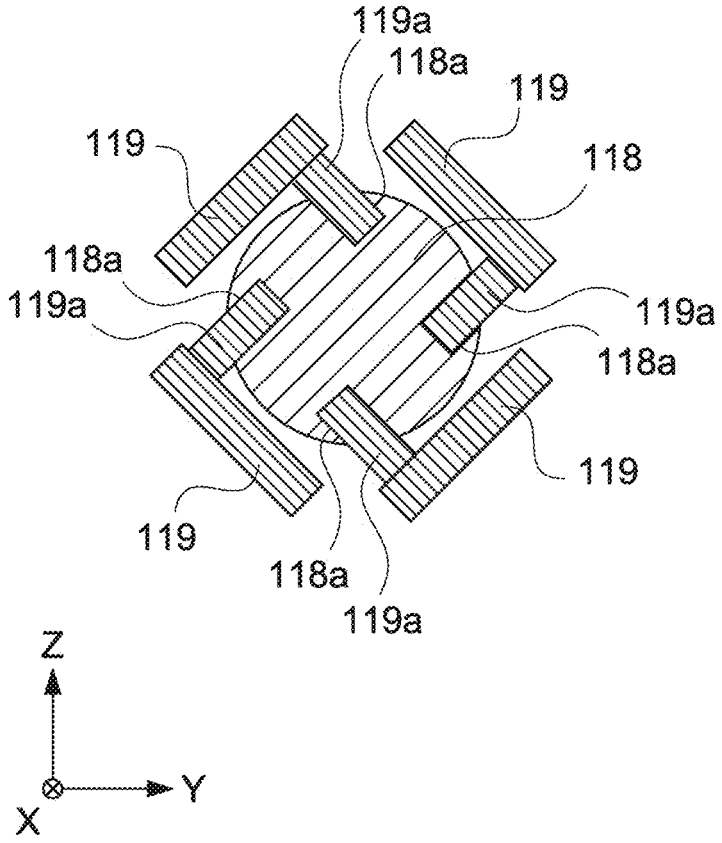
FIG. 29 is a cross-sectional view of a sliding shaft and the handle included in the fan.

FIG. 28 is a perspective view of the handle 119 and the rotary blade 111. As shown in the figure, the handle 119 and the rotary blade 111 are connected to be rotated about the center of rotation C. A protrusion 119*a* is provided at a position distant from the center of rotation C of the handle 119. FIG. 29 is a cross-sectional view of the handle 119 and the sliding shaft 118. As shown in FIG. 29, the sliding shaft 118 has the same number of recesses 118*a* as that of the handles 119, and the protrusions 119*a* are inserted into the respective recesses 118*a*. Thus, when the sliding shaft 118 slides by the drive of the pitch drive source 114, each handle 119 and rotary blade 111 rotate about the center of rotation C, and the pitch angle of each rotary blade 111 changes.

Figure 30A:
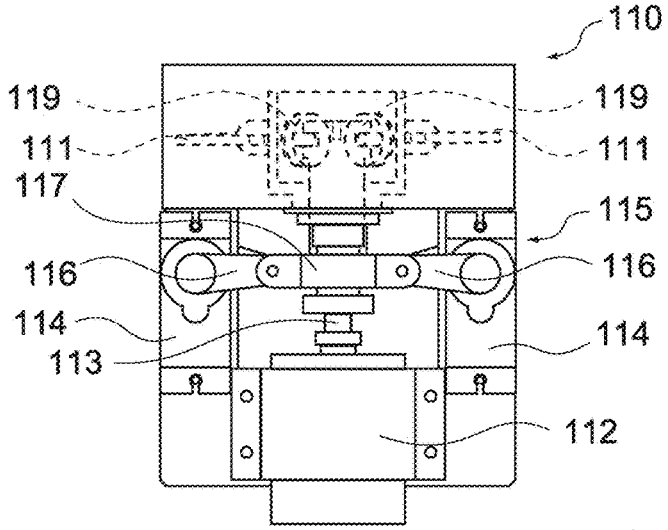
FIGS. 30A, 30B, and 30C are schematic views showing an operation of a pitch angle changing mechanism included in the fan.
Figure 30B:
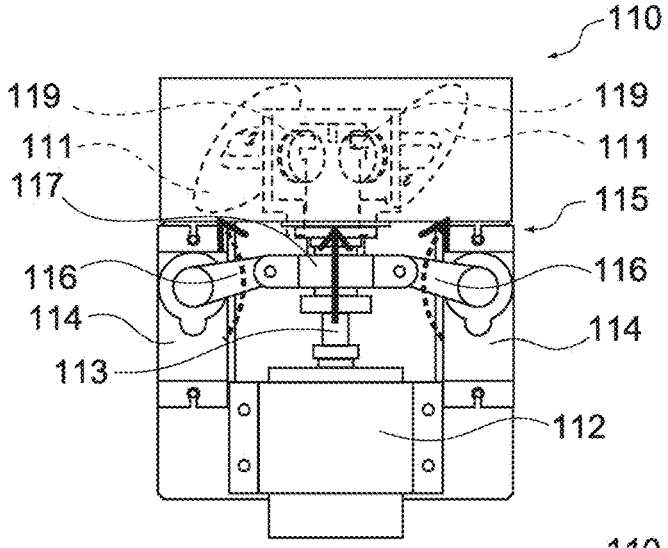
Figure 30C:
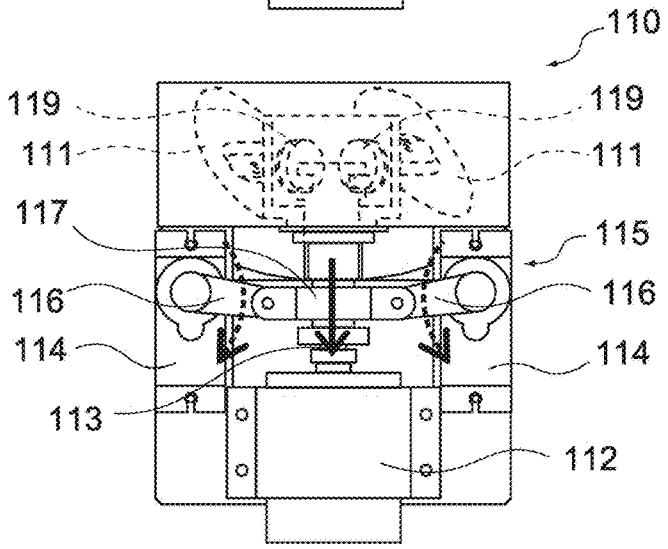
Figure 30C:
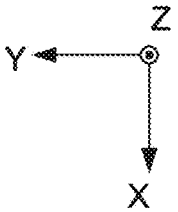
Figure 31A:
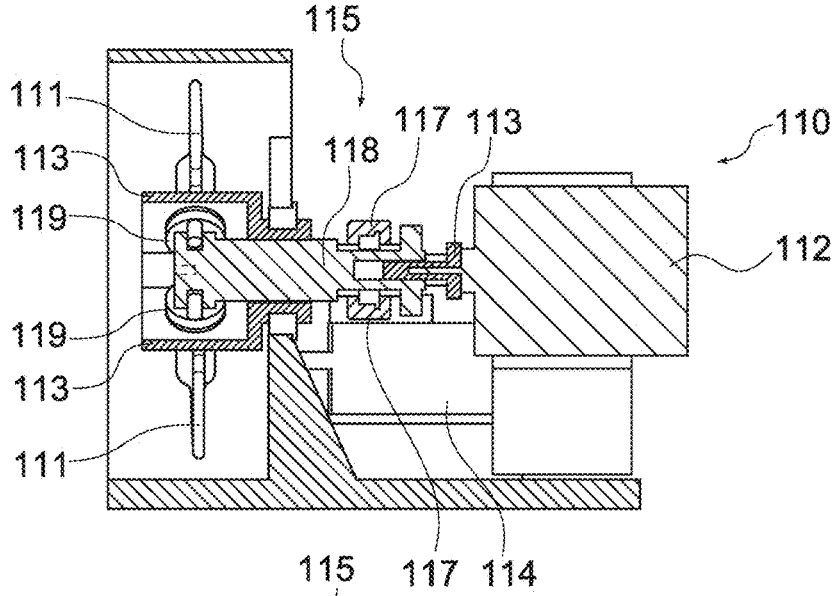
FIGS. 31A, 31B, and 31C are schematic views showing an operation of the pitch angle changing mechanism included in the fan.
Figure 31B:
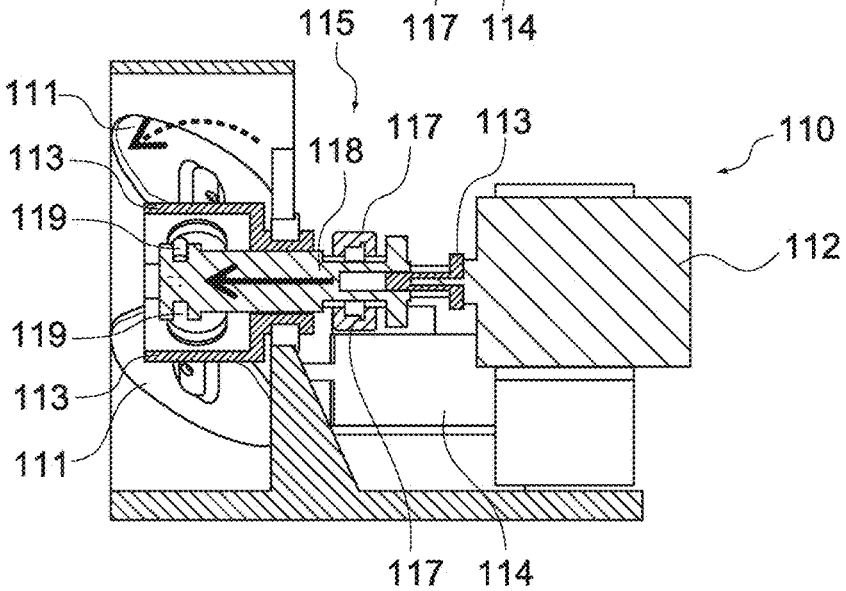
Figure 31C:
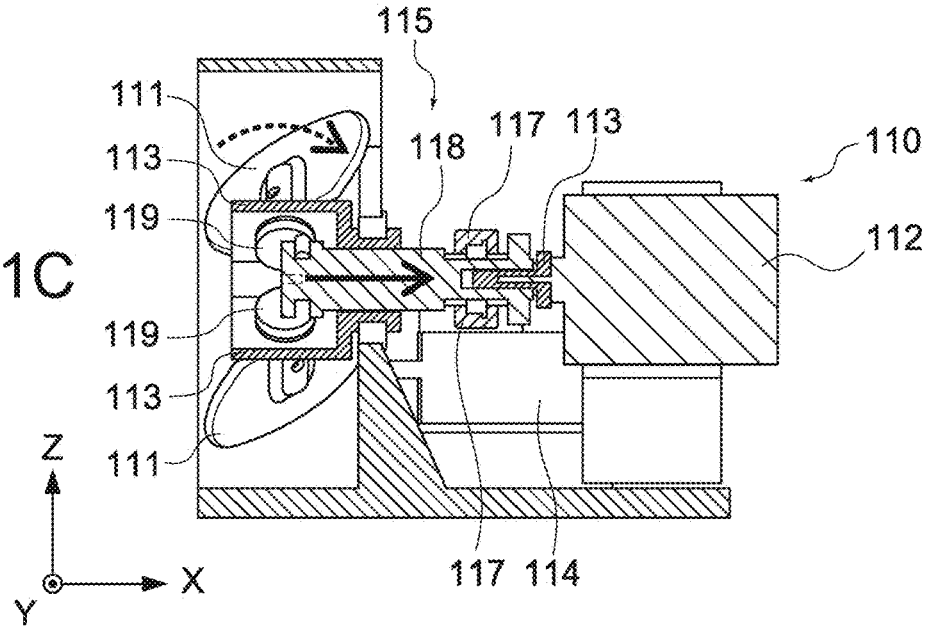
Figure 32A:
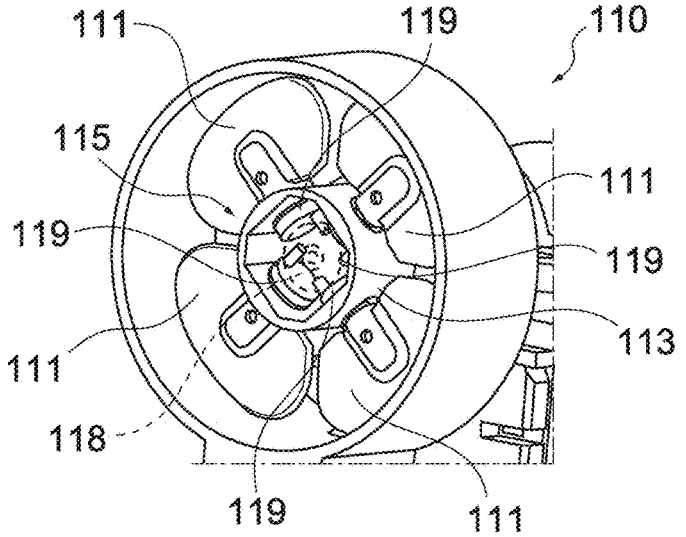
FIGS. 32A, 32B, and 32C are schematic views showing a change in pitch angle of the rotary blades.
Figure 32B:
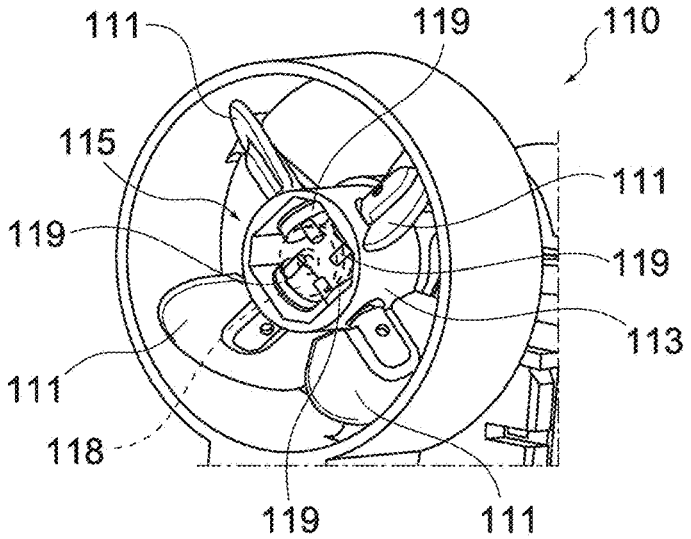
Figure 32C:
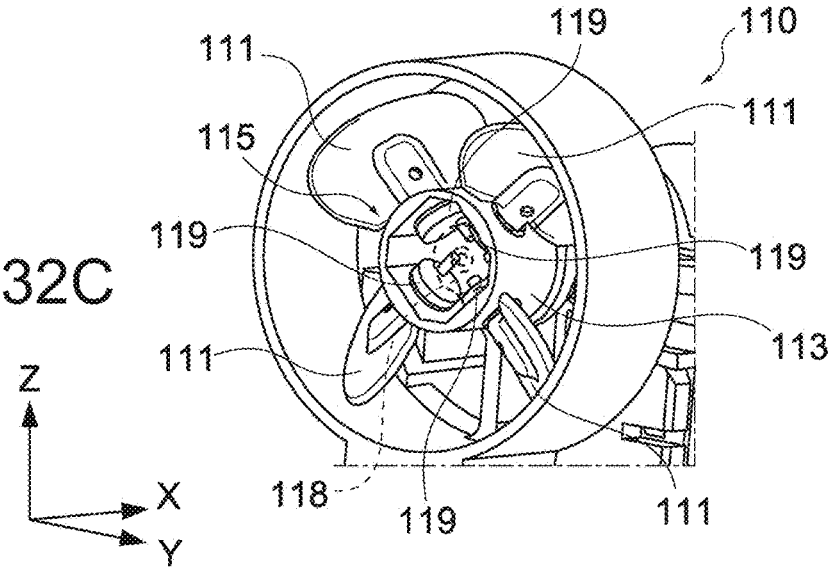
Figure 33A:
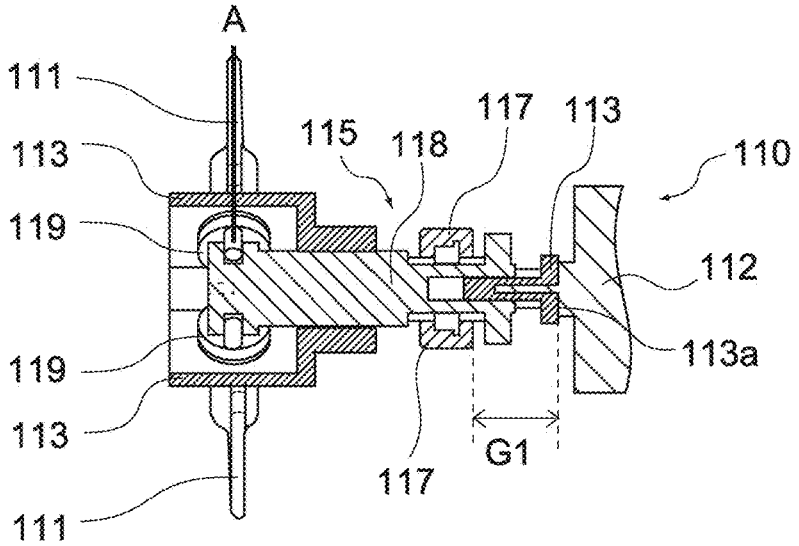
FIGS. 33A, 33B, and 33C are schematic views showing a change in pitch angle of the rotary blades.
Figure 33B:
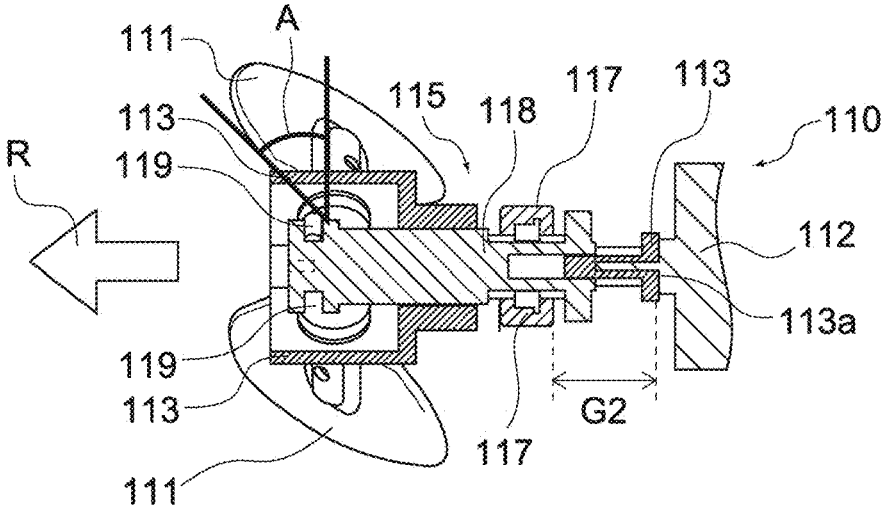
Figure 33C:
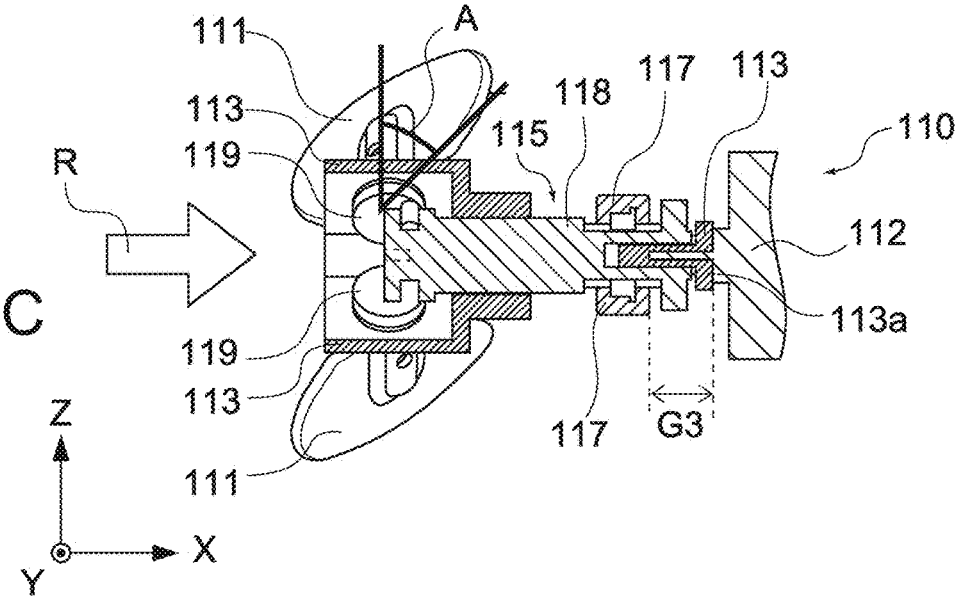

FIGS. 30A, 30B, 30C, 31A, 31B, 31C, 32A, 32B, 32C, 33A, 33B, and 33C are schematic views showing the change in pitch angle of the fan 110. FIGS. 33A, 33B, and 33C show the distance between one end 113*a* of the rotary shaft 113 and the movable portion 117 as distances G1 to G3, a pitch angle A, and airflow R. In the state shown in FIG. 30A, the movable portion 117 is located at a predetermined position, and the distance between one end of the rotary shaft 113 and the movable portion 117 is distance G1 as shown in FIG. 33A. At that time, the rotary blades 111 have a pitch angle A of 0° as shown in FIG. 31A, FIG. 32A, and FIG. 33A, and the blade surfaces are perpendicular to the axial direction (X direction) of the rotary shaft 113. In this state, no airflow is generated even when the rotary blades 111 are rotated.

As shown in FIG. 30B, when the pitch drive sources 114 are driven to rotate the arms 116 as indicated by the dashed arrows, the movable portion 117 and the sliding shaft 118 move away from the rotary drive source 112 along the axial direction (X direction) of the rotary shaft 113 as indicated by the solid arrows in FIG. 30B and FIG. 31B. As shown in FIG. 33B, the distance G2 between the one end 113*a* of the rotary shaft 113 and the movable portion 117 is larger than the distance G1, and the difference is, for example, 3 mm.

This movement of the sliding shaft 118 rotates the handles 119, and the rotary blades 111 rotate as indicated by the dashed arrow in FIG. 31B. Thus, the pitch angle A becomes positive as shown in FIG. 32B and FIG. 33B, and the blade surfaces of the rotary blades 111 are inclined relative to the axial direction (X direction) of the rotary shaft 113. In this state, when the rotary blades 111 are rotated, airflow R delivered from the fan 110 is generated as shown in FIG. 33B. The pitch angle A is, for example, +65°.

Next, as shown in FIG. 30C, when the pitch drive sources 114 are driven to rotate the arms 116 as indicated by the dashed arrows, the movable portion 117 and the sliding shaft 118 move to approach the rotary drive source 112 along the axial direction (X direction) of the rotary shaft 113 as indicated by the solid arrows in FIG. 30C and FIG. 31C. As shown in FIG. 33C, the distance G3 between the one end 113*a* of the rotary shaft 113 and the movable portion 117 is smaller than the distance G1, and the difference is, for example, 3 mm.

This movement of the sliding shaft 118 rotates the handles 119, and the rotary blades 111 rotate as indicated by the dashed arrow in FIG. 31C. Thus, the pitch angle A becomes negative as shown in FIG. 32C and FIG. 33C, and the blade surfaces of the rotary blades 111 are inclined relative to the axial direction (X direction) of the rotary shaft 113. In this state, when the rotary blades 111 are rotated, airflow R drawn into the fan 110 is generated as shown in FIG. 33B. The pitch angle A is, for example, −65°.

The pitch angle changing mechanism 105 has the configuration described above. Note that the configuration of the pitch angle changing mechanism 105 is not limited to one described above as long as it transmits the power of the pitch drive sources 114 in a direction parallel to the axial direction (X direction) of the rotary shaft 113 separately from the rotation of the rotary shaft 113, and changes the pitch angle of the rotary blades 111. For example, the pitch angle changing mechanism 105 may be a mechanism using a feed screw that produces a linear motion when rotated, for example.

As described above, the fan 110 can change the pitch angle of the rotary blades 111 independently of the rotation of the rotary blades 111. This allows the fan 110 to quickly control the flow velocity of the airflow (including the presence or absence of airflow). Specifically, when the pitch angle is changed in the case where the rotary blades 111 are rotating at a constant speed with the pitch angle being set to 0°, the fan 110 can immediately generate airflow. In the case of a general fan, when the rotary blades are rotated to generate airflow from a state where the rotary blades are stopped and no airflow is generated, it is difficult to immediately generate airflow because it takes time for the rotation speed to increase. Similarly, when the flow velocity of the airflow is changed, the fan 110 can immediately change the flow velocity by changing the pitch angle, but a general fan fails to immediately change the flow velocity because it takes time to change the rotation speed.

As described above, in the airflow control apparatus 100, it is possible to increase the control range of the degree of convergence and diffusion of the airflow F (see FIGS. 22 and 23) by controlling the rectifying plate unit 120 and the nozzle 130 and to enhance spatial resolution of the airflow F. Further, by making the fan 110 capable of changing the pitch angle, the flow velocity of the airflow can be quickly controlled, and the temporal resolution of the airflow F can be enhanced. Therefore, in the airflow control apparatus 100, it is possible to achieve high resolution in both the spatial resolution and the temporal resolution of the airflow F.

Modified Examples

Figure 34A:
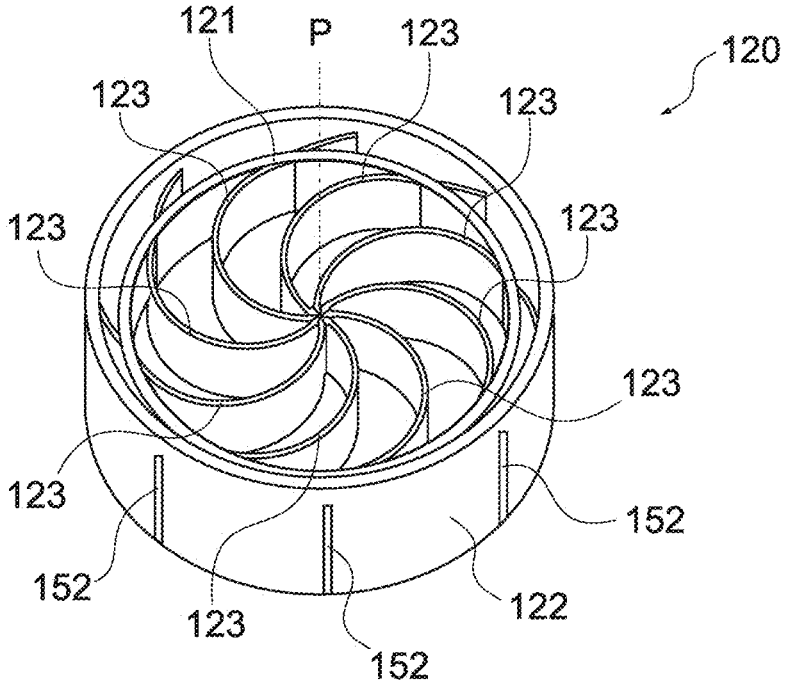
FIGS. 34A and 34B are schematic views showing an operation of a rectifying plate unit according to a modified example of the present technology.
Figure 34B:
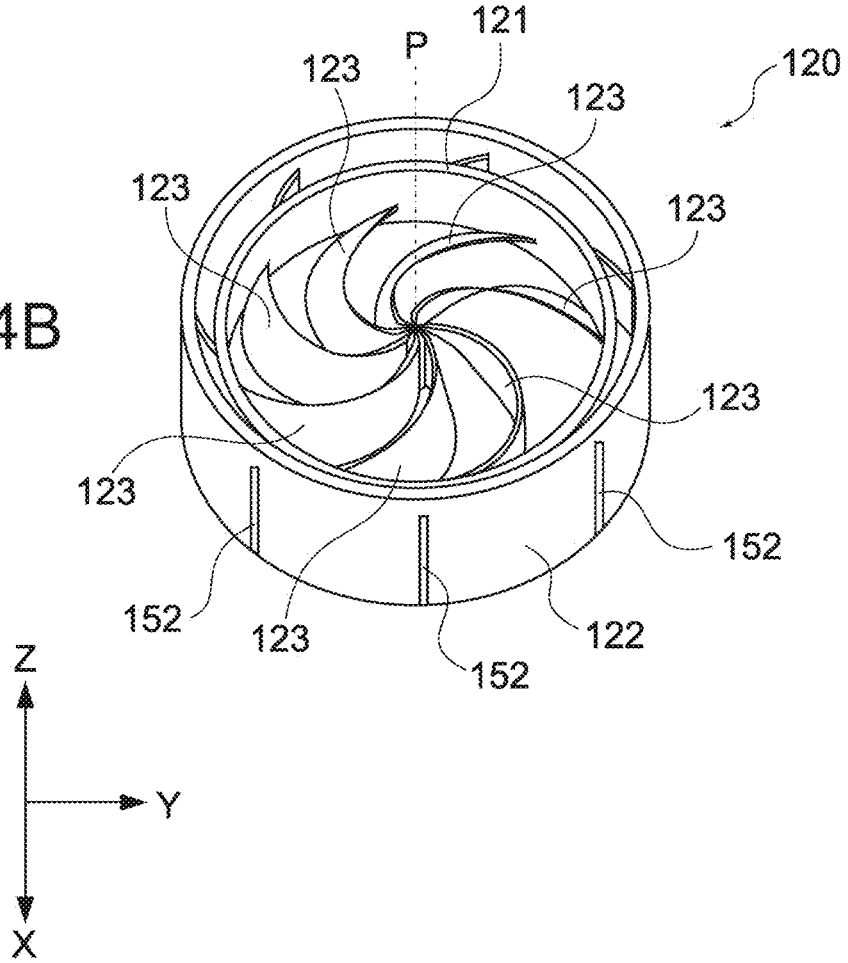

The rectifying plate unit 120 can also be configured as follows. FIGS. 34A and 34B are perspective views of the rectifying plate unit 120 according to a modified example. The rectifying plates 123 may change between a state parallel to the center of rotation P shown in FIG. 34A and a state inclined relative to the center of rotation P shown in FIG. 34B by relative rotation of the first frame 121 and the second frame 122 about the center of rotation P.

Figure 35A:
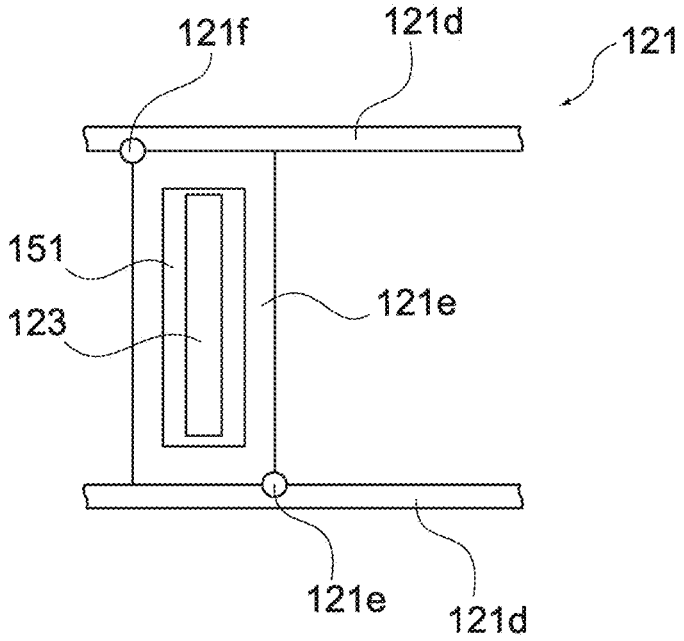
FIGS. 35A and 35B are schematic views showing an operation of the rectifying plate unit.
Figure 35B:
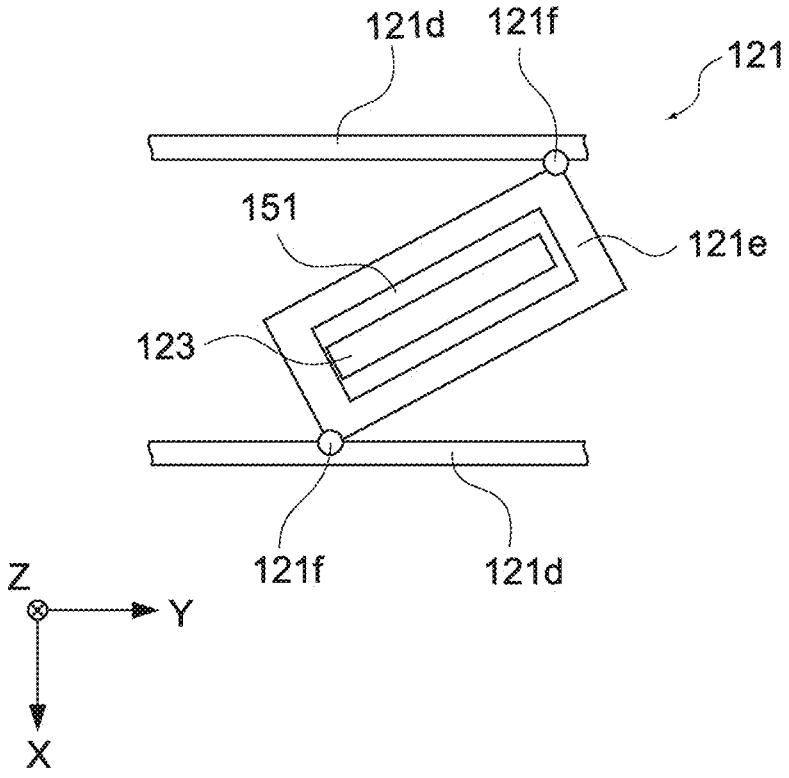

FIGS. 35A and 35B are schematic views showing the first frame 121 of such a rectifying plate unit 120. As shown in FIGS. 35A and 35B, the first frame 121 may include a frame member 121*d*, a movable member 121*e*, and a rotary shaft 121*f*. The movable member 121*e* is connected to the frame member 121*d* by the rotary shaft 121*f* and changes between an upright state shown in FIG. 35A and an inclined state shown in FIG. 35B. The through-hole 151 is provided in the movable member 121*e* and has a slit shape, the longitudinal direction of which changes between a direction parallel to the center of rotation P (X direction) and a direction inclined relative to the same direction.

The rectifying plate 123 is inserted into each through-hole 151, and the length L of the portion 123*c* (see FIGS. 12 and 13) changes by the relative rotation of the first frame 121 and the second frame 122 about the center of rotation P. Thus, the movable member 121*e* receives power from the rectifying plate 123, and the angle of the movable member 121*e* changes as shown in FIGS. 35A and 35B. Thus, the rectifying plate 123 also inclines as it moves away from the center of rotation P as shown in FIGS. 34A and 34B. In this configuration, the effect of the convergence or diffusion of airflow by the rectifying plate 123 can be made greater.

[Configuration of Airflow Control System]

Figure 36:
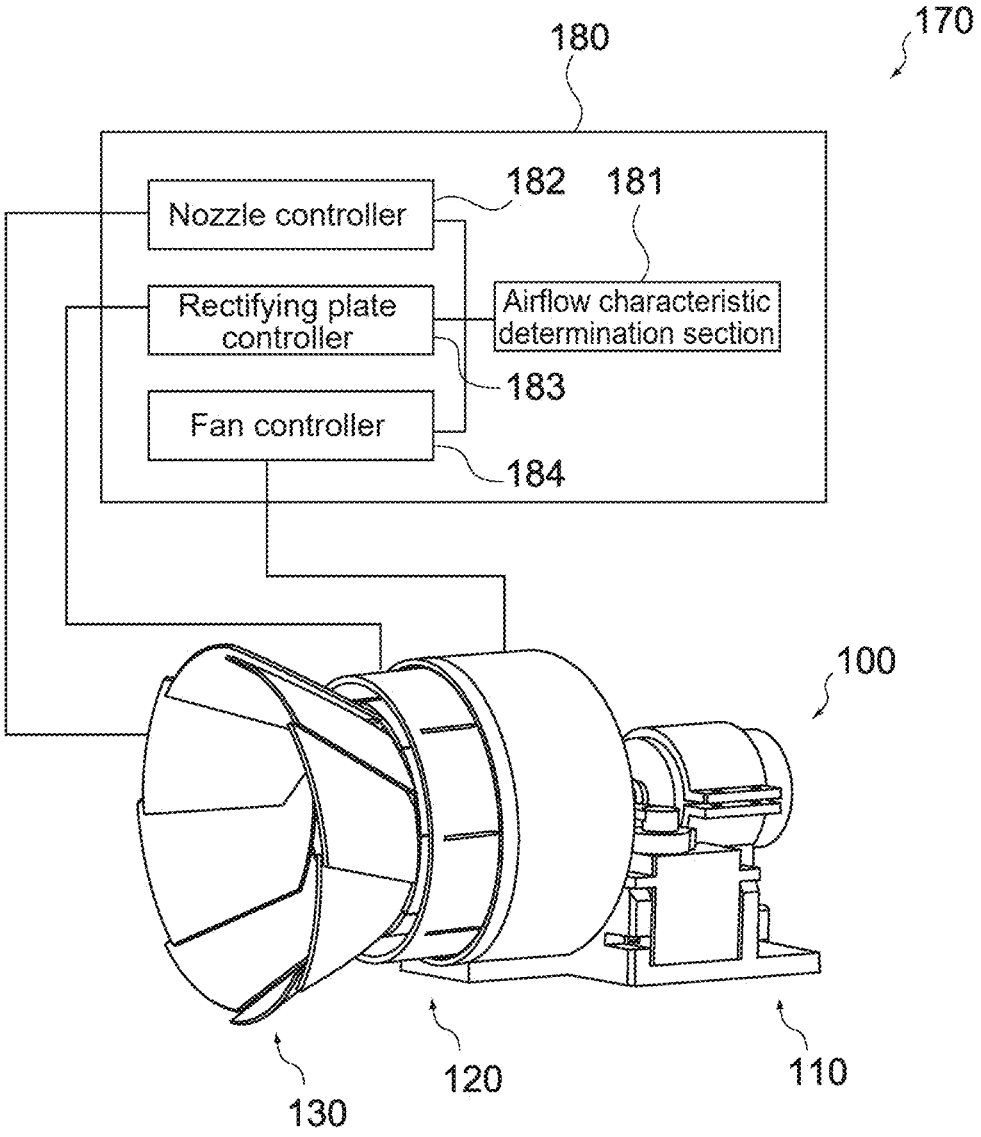
FIG. 36 is a schematic view of an airflow control system according to an embodiment of the present technology.

An airflow control system according to this embodiment will be described. FIG. 36 is a schematic view showing a configuration of an airflow control system 170 according to this embodiment. As shown in the figure, the airflow control system 170 includes the airflow control apparatus 100 described above and a controller 180. The controller 180 includes an airflow characteristic determination section 181, a nozzle controller 182, a rectifying plate controller 183, and a fan controller 184. Each of the components of the controller 180 is a functional component implemented by the cooperation of software and hardware.

The airflow characteristic determination section 181 determines the characteristics of the airflow to be generated by the airflow control apparatus 100 (hereinafter, referred to as airflow characteristics). The airflow characteristics include the start timing of airflow generation, the stop timing of airflow generation, the flow velocity, the degree of diffusion and convergence, and the like. The airflow characteristic determination section 181 can acquire audiovisual content from the controller 180 or another information processing apparatus to determine airflow characteristics, which are read from the audiovisual content or generated on the basis of the details of the content.

Specifically, the controller 180 can determine airflow characteristics so as to present the airflow simulated in a space in a virtual space to a user. Additionally, the airflow characteristic determination section 181 can further determine airflow characteristics on the basis of information about the airflow control apparatus 100, such as the position of the airflow control apparatus 100 and its relative position to the user. Once the airflow characteristic determination section 181 determines airflow characteristics, the airflow characteristic determination section 181 determines the parameters to achieve the airflow characteristics and supplies them to the nozzle controller 182, the rectifying plate controller 183, and the fan controller 184.

The nozzle controller 182 controls the nozzle 130 to define the nozzle diameter D (see FIGS. 20 and 21) in accordance with the parameters supplied by the airflow characteristic determination section 181. The rectifying plate controller 183 controls the rectifying plate unit 120 to define the relative rotation angles of the first frame 121 and the second frame 122 in accordance with the parameters supplied by the airflow characteristic determination section 181. The fan controller 184 defines the operation timing of the rotary drive source 112 and the pitch drive source 114, the rotation speed, and the rotation angle in accordance with the parameters supplied by the airflow characteristic determination section 181.

The airflow control system 170 has the configuration as described above. The controller 180 can control at least any one of the fan 110, the rectifying plate unit 120, or the nozzle 130 in the airflow control apparatus 100 to change the degree of convergence and diffusion of the airflow and the flow velocity thereof, thus allowing presentation of the airflow with desired characteristics to the user. Specifically, the controller 180 can control the airflow control apparatus 100 to present airflow simulated in the space in the virtual space to the user. Additionally, the controller 180 can also present in a pseudo manner, to the user, characteristics of the airflow observed at a specific point in the real space by controlling the airflow control apparatus 100.

In such a manner, the controller 180 can control the airflow control apparatus 100 on the basis of the flow velocity and the range of reach of the airflow to be presented to the user. As described above, in the airflow control apparatus 100, both the spatial resolution and the temporal resolution of the airflow can be enhanced, so that the airflow control system 170 can present airflow corresponding to the details of the audiovisual content. Note that the controller 180 is not limited to one including all of the airflow characteristic determination section 181, the nozzle controller 182, the rectifying plate controller 183, and the fan controller 184, but it only needs to include at least the rectifying plate controller 183.

[Specific Examples of Control by Airflow Control System]

Figure 37:
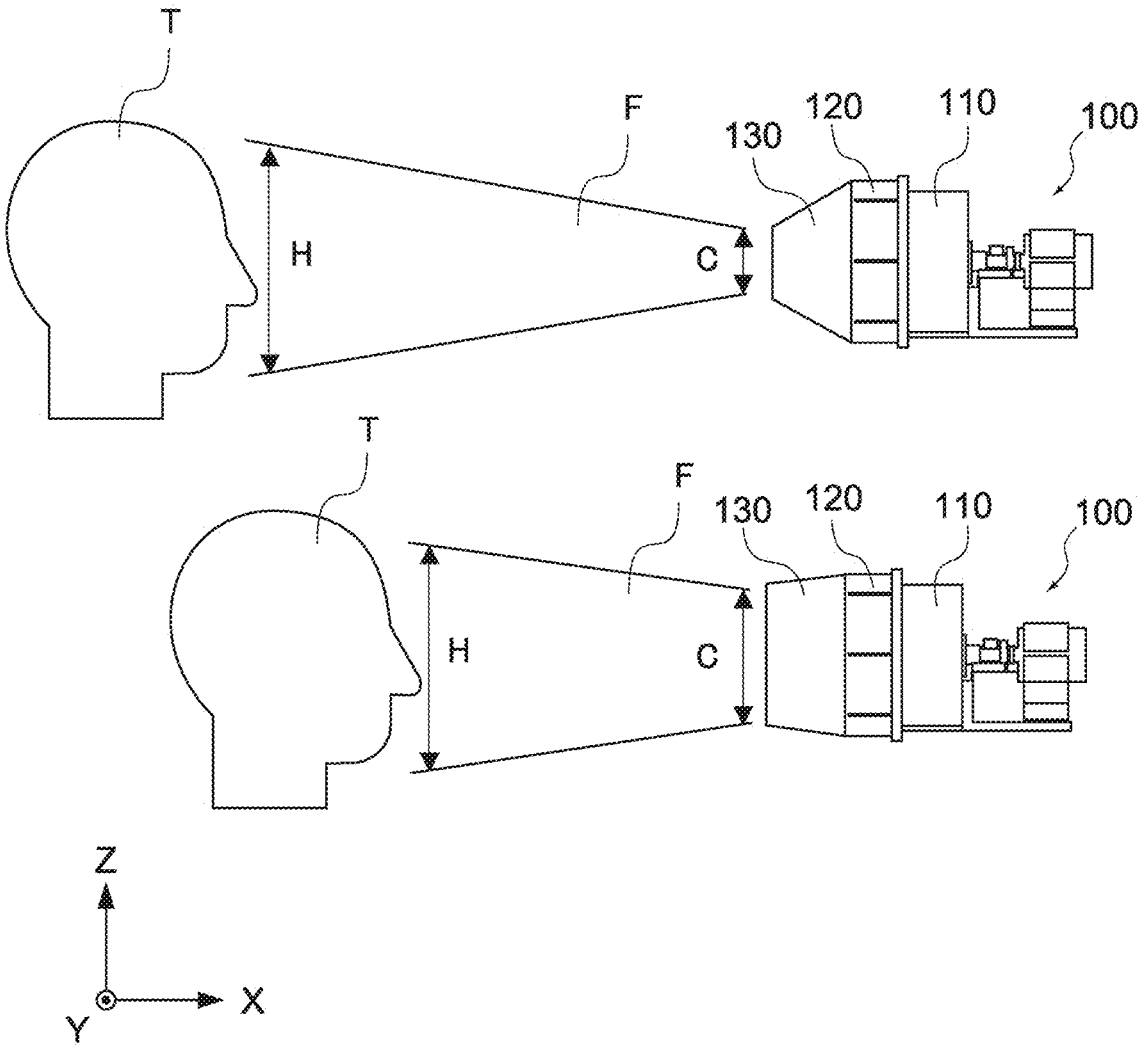
FIG. 37 is a schematic view showing an operation of the airflow control system.

The controller 180 can control airflow in accordance with the installation state of the airflow control apparatus 100. FIG. 37 is a schematic view showing a control method according to the installation state of the airflow control apparatus 100. As shown in the figure, since the airflow F diffuses in accordance with the distance between a user T and the airflow control apparatus 100, the controller 180 can calculate backward a diffusion range H of the airflow F at the position of the user T to be a desired range, thus determining the degree of convergence and diffusion C of the airflow F.

Additionally, in consideration of the distance between the user T and the airflow control apparatus 100 and the arrival time of the airflow, the controller 180 can shift forward the timing of airflow delivery of the airflow control apparatus 100 to obtain a desired presentation timing in accordance with the distance. Further, if the frequency of the change in flow velocity of the airflow delivered by the airflow control apparatus 100 exceeds a certain level (e.g., 100 Hz or more), as the user T and the airflow control apparatus 100 are separated more away from each other, the frequency of the change in flow velocity decreases, so that the airflow is perceived as a continuous airflow. Thus, the controller 180 can make the frequency of the change in flow velocity smaller in accordance with the distance between the user T and the airflow control apparatus 100 to control a change in frequency of the airflow to be presented.

Regarding the method of controlling the flow velocity by the airflow control system 170, when the flow velocity of the airflow is increased, as a pitch angle change speed (pitch angle/second) of the rotary blades 111 becomes larger, the controller 180 overshoots the pitch angle change speed (after reaching a target value, the pitch angle change speed is made to overshoot far beyond the target value), so that the rotation speed of the rotary blades 111 is prevented from being lowered.

Additionally, when stopping the airflow, the controller 180 reverses the pitch angle of the rotary blades 111 to generate airflow in the opposite direction of the airflow already delivered, so that the arrival at a windless state can be speeded up. Further, the controller 180 can speed up the arrival at the target flow velocity by keeping the rotary drive source 112 rotating even in the windless state (see FIG. 33A), and then changing the pitch angle when starting airflow generation (see FIG. 33B). At that time, since the load on the rotary drive source 112 varies due to the pitch angle of the rotary blades 111, the flow velocity can be kept constant by changing the power input to the rotary drive source 112 in accordance with the rotation speed. For example, the load on the rotary drive source 112 is the lowest in the windless state (see FIG. 33A), but the load increases when the pitch angle is changed (see FIG. 33B), and thus the rotation speed of the rotary drive source 112 can be increased in accordance with a desired flow velocity.

Further, in order to maintain a constant flow velocity of the airflow presented to the user even if the convergence range of the airflow is changed, the controller 180 may automatically adjust the pitch angle of the rotary blades 111 and the rotation speed of the rotary drive source 112 in accordance with the convergence range. In order to reach a desired flow velocity, the controller 180 can select one that is optimal in terms of energy efficiency from the two parameters, i.e., the pitch angle of the rotary blades 111 and the rotation speed of the rotary drive source 112, one of which is to be increased and the other one of which is to be decreased. In this case, it is energetically advantageous if the flow velocity can be increased only by the change in pitch angle without increasing the rotation speed.

Regarding the method of controlling a wind direction by the airflow control system 170, in order to give a feeling of wind direction, the controller 180 may present a feeling that the wind direction has been changed by switching the suction and blowoff of airflow by the change in pitch angle, without moving the fan 110 itself. Additionally, the airflow control apparatus 100 itself can also be moved to control the wind direction. In order to make the user feel as if the wind is blowing from the front, the following operation may be repeated: delivering airflow while moving the airflow control apparatus 100 from the front to the back, and returning the airflow control apparatus 100 from the back to the front with the airflow being stopped.

Figure 38:
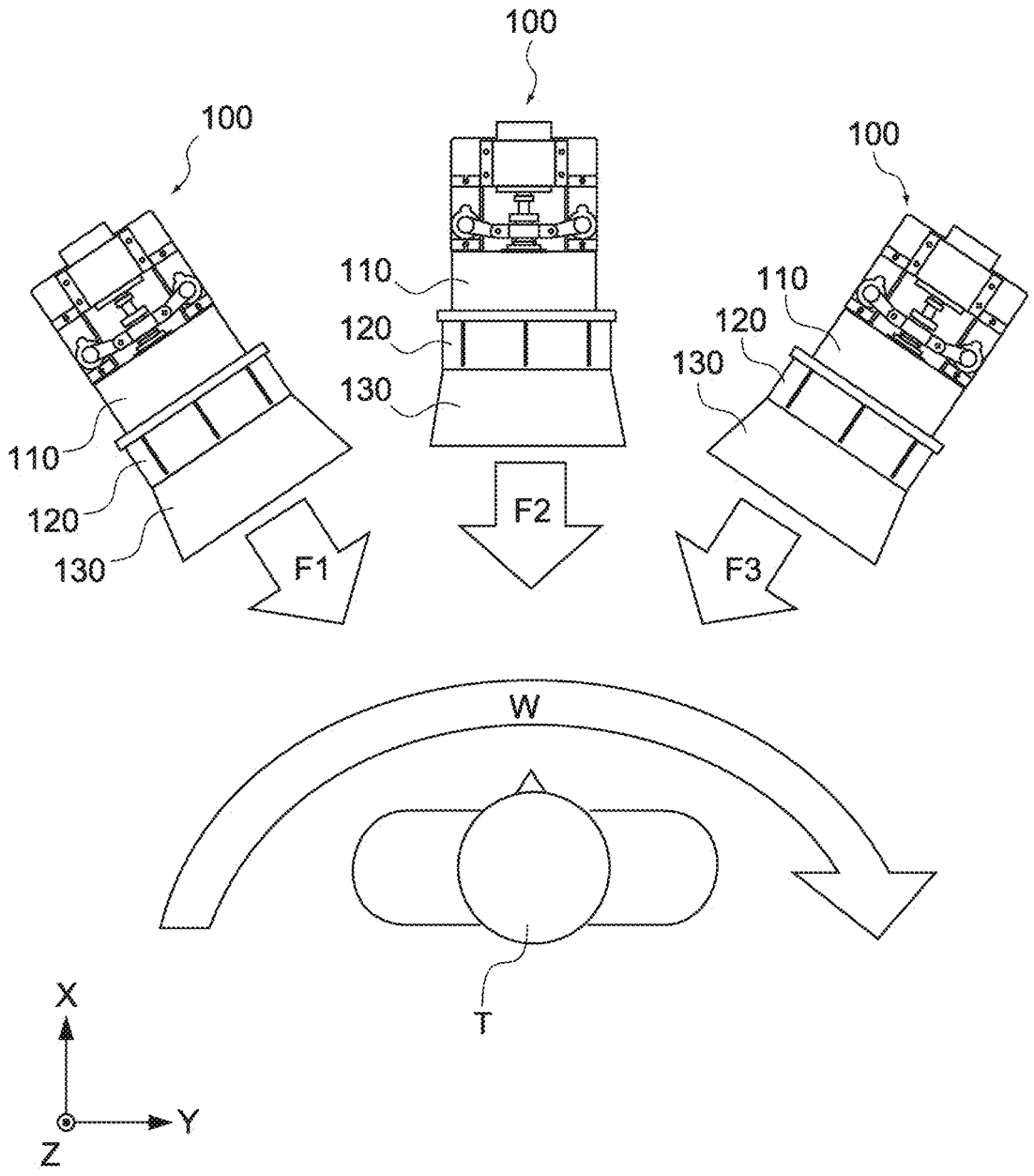
FIG. 38 is a schematic view showing an operation of the airflow control system.

FIG. 38 is a schematic view showing a positional relationship between the user T and the airflow control apparatus 100. As shown in the figure, the controller 180 delivers airflow F1, airflow F2, and airflow F3 in sequence at different timings of airflow delivery at each position while moving the airflow control apparatus 100 to right and left, and then repeating this operation to create the illusion that the wind is flowing from left to right as indicated by the arrow W in the figure (apparent effect). Additionally, when a plurality of airflow control apparatuses 100 is used, airflow can be delivered from each airflow control apparatus 100 in the order of airflow F1, airflow F2, and airflow F3 as shown in FIG. 38 so as to present a feeling of wind direction using the apparent motion effect. Further, if the airflow control apparatuses 100 are installed on both sides of the user's neck, it is also possible to improve the experience of wind speed by controlling the pitch angle in the blowing direction on one side and in the intake direction on the other side.

Regarding the method of controlling a temperature by the airflow control system 170, the airflow control apparatus 100 includes a hot or cold heat source at an inlet portion, which makes it possible to present temperature together with airflow. In this case, the controller 180 can adjust the flow velocity to the extent that the airflow is not felt, and present only the temperature. Additionally, the airflow control apparatus 100 can also generate airflow in the intake direction such that the airflow is not felt, and present only a cooling sensation.

[Application Examples of Airflow Control System]

Application examples of the airflow control system 170 will be described. The airflow control apparatus 100 can be mounted on a neck-mounted device that is worn around the neck of a user. When the user wearing such a device is watching an environmental video, the video shows a flowing river and shaking leaves on a tree, and the user is recalling that the wind is blowing. In the airflow control system 170, the controller 180 can control the airflow control apparatus 100 to deliver airflow to the user at a set timing synchronized with the video.

For example, when the wind is not blowing in the video, the rotary blades 111 rotate with the pitch angle being set to be horizontal relative to an outlet or set to an angle at which airflow is slightly taken in, so that airflow is not delivered from the airflow control apparatus 100 to the user. When the wind blows in the video, the controller 180 controls the airflow control apparatus 100 to change the pitch angle in the blowing direction and delivers airflow to the user. At that time, in order to present the airflow over a wide range of the user's body, the controller 180 sets the nozzle diameter of the nozzle 130 to an open state and the rectifying plate unit 120 to a state of diffusing the airflow.

The content creator can set the flow velocity and the diffusion range of the airflow as parameters. The controller 180 can calculate the pitch angle of the rotary blades 111 and the rotation speed of the rotary drive source 112 on the basis of the flow velocity, and can calculate the degree of diffusion and convergence by the rectifying plate unit 120 and the nozzle 130 on the basis of the diffusion range. In this case, the degree of diffusion and convergence can be changed in accordance with the distance between the user and the airflow control apparatus 100, and the pitch angle and the rotation speed can be controlled to maintain the target flow velocity because the flow velocity is increased when the airflow converges.

Further, the controller 180 may adjust the degree of diffusion and convergence of the airflow according to the sound frequency of the content (low frequency→diffusion/ low speed, high frequency→convergence/high speed). The controller 180 may use a sensor to measure the distance between the user and the airflow control apparatus 100. In this case, the flow velocity of the airflow delivered by the airflow control apparatus 100 is calculated backward from the flow velocity of the airflow when it reaches the user. Further, the airflow control apparatus 100 can be used with a hot or cold heat source provided at the inlet portion to vary the temperature of the airflow.

Furthermore, when an event occurs in an action game, etc., in which an object passes near a user-operated character, the controller 180 can control the airflow control apparatus 100 to present airflow corresponding to the object. For example, the airflow control apparatus 100 can briefly present airflow converging to a narrow range when the object is small and passes fast, like a bullet, and can present continuous airflow over a wide range when a train passes in front of the user. Additionally, for example, when a user-operated character is running, the airflow control apparatus 100 can also change the flow velocity of the airflow delivered to the user in accordance with the moving speed of the character and present the moving speed.

Furthermore, when the wind is not blowing in the game, the controller 180 rotates the rotary blades 111 with the pitch angle being set to be horizontal relative to an outlet or set to an angle at which airflow is slightly taken in, so that airflow is not delivered from the airflow control apparatus 100 to the user. When the wind blows in the game, the controller 180 changes the pitch angle of the rotary blades 111 in the blowing direction for a short time and then immediately changes it in the horizontal direction, and can thus present the short-time airflow. At that time, in order to present the airflow to a small range of the user's body, the controller 180 sets the nozzle 130 to be closed and the rectifying plate unit 120 to a state of diffusing the airflow.

Furthermore, the controller 180 can perform the following in order to present the airflow exceeding the flow velocity that can be achieved by the airflow control apparatus 100 or emphasize the change in flow velocity. If the rate of change in flow velocity has a certain level or more, or if the flow velocity specified in the content exceeds the flow velocity that can be achieved by the airflow control apparatus 100, the controller 180 may create a windless state immediately before the change in flow velocity in order to create the illusion of a strong wind. For example, when the flow velocity is specified as 3→10, the controller 180 can set 3→3→0→7→7 etc., and in order to achieve a difference of 7 of 3→10, can present a windless state once and then present a flow velocity of 7.

Furthermore, in order to present the windless state with emphasis, the controller 180 may control the flow velocity to be suddenly reduced to zero after presenting airflow of a steady, weak flow velocity by intention. Additionally, when the rate of change in flow velocity has a certain level or more, the controller 180 may also overshoot the flow velocity presented to the user by intention in order to emphasize the change. For example, when the flow velocity changes suddenly from 0 to 1, the controller 180 may change the flow velocity from 0→0→2→1→1. The position of the airflow control apparatus 100 worn by the user is not limited to the neck, but it can also be the hand or foot. In this case, the controller 180 may present airflow in response to the movement of the hand or foot. Additionally, when the airflow control apparatus 100 is worn on the hand, the controller 180 can also present the motion of attracting or releasing a virtual object in a virtual reality (VR) space by the suction or emission of airflow.

[Regarding Other Configurations of Fan]

Figure 39:
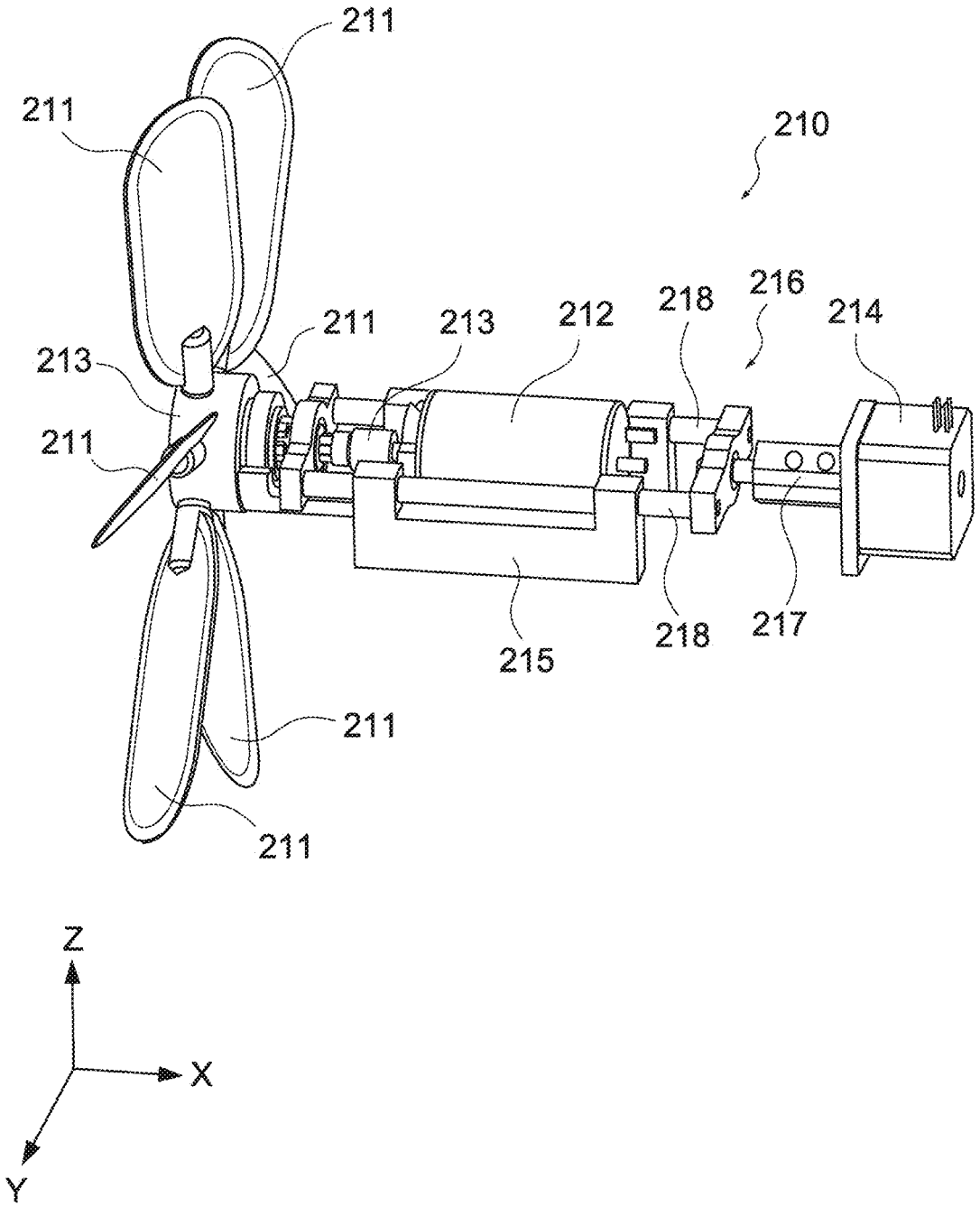
FIG. 39 is a perspective view of a fan having another configuration included in the airflow control apparatus.
Figure 40:
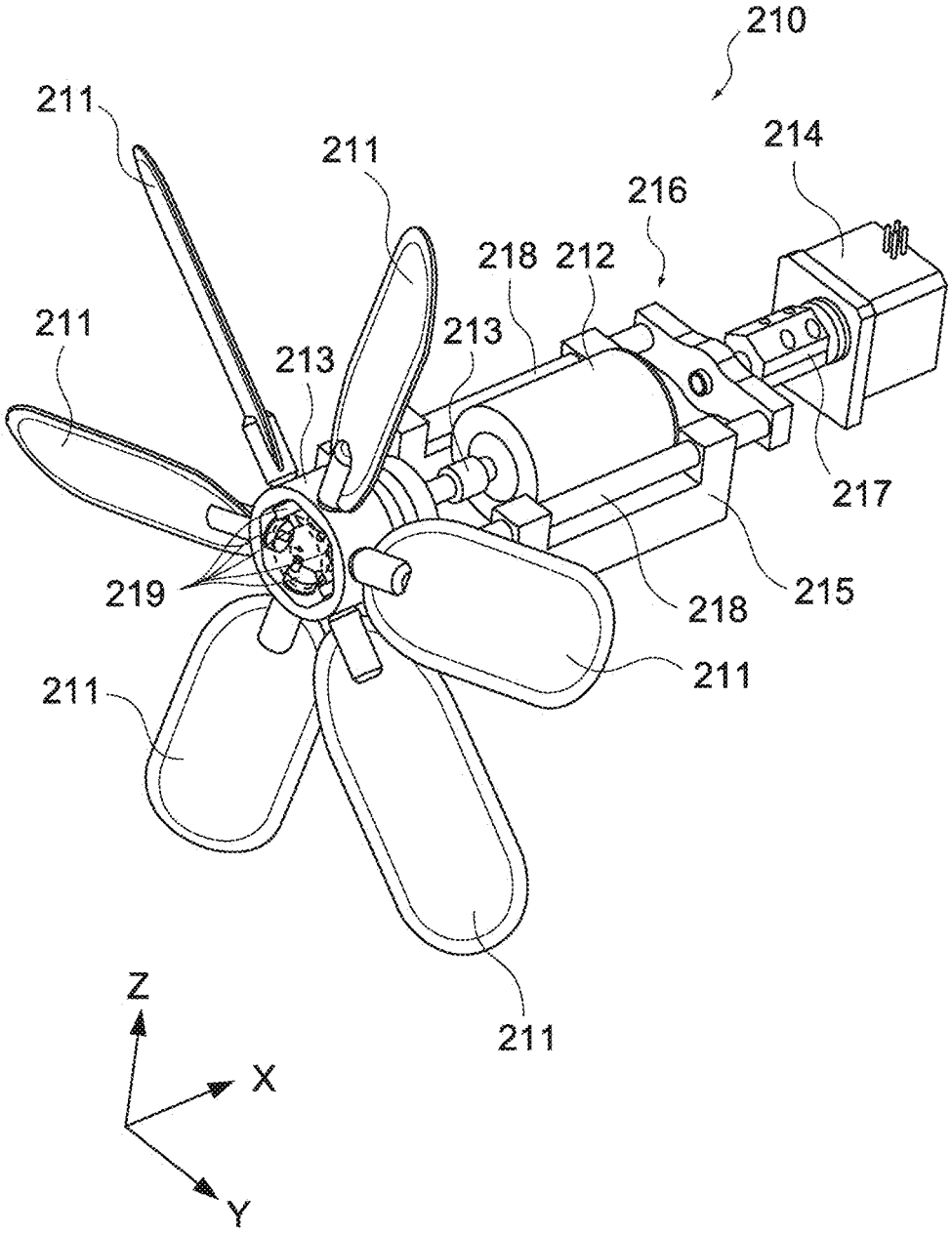
FIG. 40 is a perspective view of a fan having another configuration included in the airflow control apparatus.

FIGS. 39 and 40 are perspective views of a fan 210. The airflow control apparatus 100 described above can include a fan 210 instead of the fan 110. As shown in FIGS. 39 and 40, the fan 210 includes rotary blades 211, a rotary drive source 212, a rotary shaft 213, a pitch drive source 214, a fixed portion 215, and a pitch angle changing mechanism 216.

As shown in FIG. 40, six rotary blades 211 are provided. Each of the rotary blades 211 is connected to the rotary shaft 213 and rotated by the rotary shaft 213. Additionally, the pitch angle of each of the rotary blades 211 is changed by the pitch angle changing mechanism 216. The shape and number of rotary blades 211 are not particularly limited.

The rotary drive source 212 generates rotary power. For the rotary drive source 212, a direct current (DC) motor can be used, but other types of motors may also be used. The rotary shaft 213 is a shaft with the X direction as a longitudinal direction and connects the rotary blades 211 and the rotary drive source 212. The rotary shaft 213 is rotated by the rotary drive source 212 to rotate the rotary blades 211.

The pitch drive source 214 generates rotary power used to change the pitch angle of the rotary blades 211. For the pitch drive source 214, a step motor can be used, but other types of motors may also be used. The fixed portion 215 is fixed at its position and supports the rotary drive source 212 and a sliding shaft 218. The pitch angle changing mechanism 216 transmits the power of the pitch drive source 214 in a direction parallel to the axial direction (X direction) of the rotary shaft 213 separately from the rotation of the rotary shaft 213, and changes the pitch angle of the rotary blades 211.

Specifically, the pitch angle changing mechanism 216 includes a rotation conversion portion 217, the sliding shaft 218, and handles 219 (see FIG. 40). The rotation conversion portion 217 connects the output shaft of the pitch drive source 214 and the sliding shaft 218, and converts the rotation of the output shaft into the movement of the sliding shaft 218 in the direction parallel to the axial direction (X direction) of the rotary shaft 213.

Figure 41:
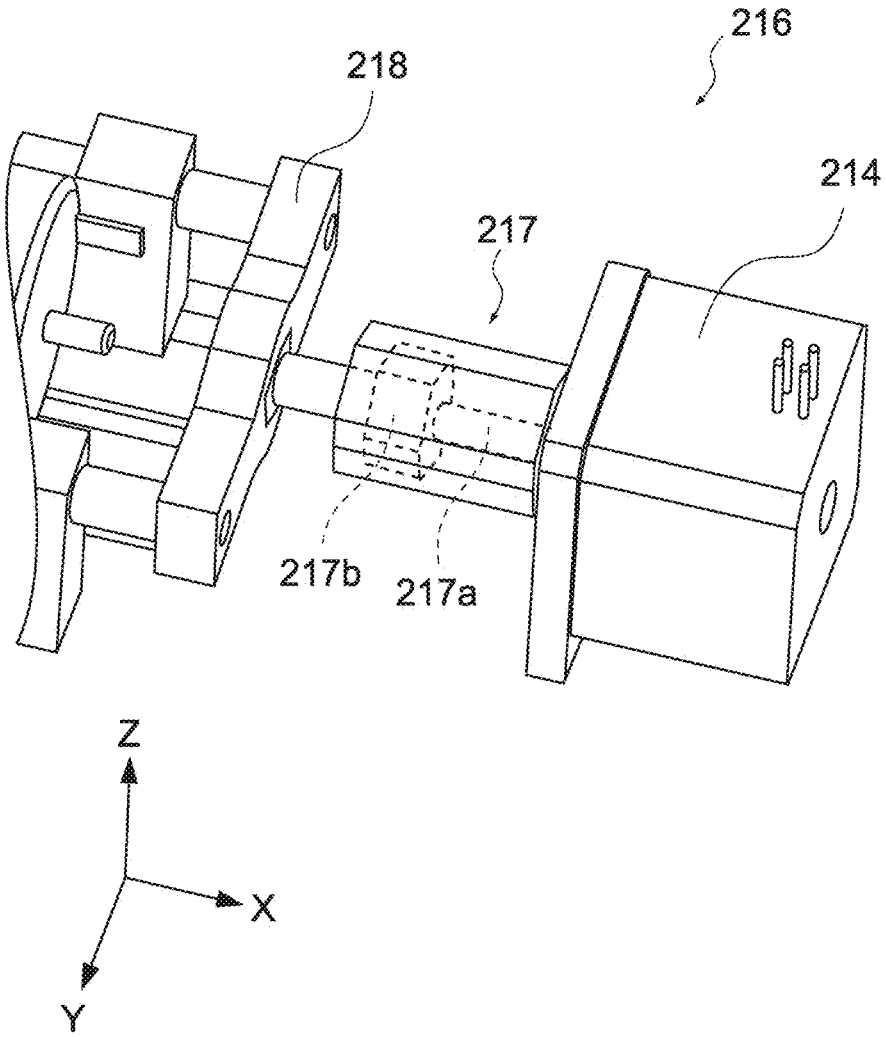
FIG. 41 is a perspective view of the vicinity of a rotation conversion portion (sliding screw system) of a fan having another configuration included in the airflow control apparatus.

FIG. 41 is an enlarged view of the vicinity of the rotation conversion portion 217. As shown in the figure, the rotation conversion portion 217 is of a sliding screw system and includes a screw shaft 217*a* and a nut 217*b*. The screw shaft 217*a* is a shaft with the X direction as a longitudinal direction, which is connected to the output shaft of the pitch drive source 214 and includes a threaded groove not shown in the figure. The nut 217*b* is screwed to the screw shaft 217*a* and moves along the screw shaft 217*a* when the screw shaft 217*a* rotates. The nut 217*b* is joined to the sliding shaft 218 and moves the sliding shaft 218 along the axial direction (X direction) of the screw shaft 217*a*.

The sliding shaft 218 (see FIG. 40) is a shaft with the X direction as a longitudinal direction, which is provided across the rotary drive source 212, is supported to be capable of connecting the rotation conversion portion 217 and the handles 219, and slides along the axial direction (X direction) by the rotation conversion portion 217. A bearing is provided between the rotary shaft 213 and the sliding shaft 218 to separate the rotation of the rotary shaft 213 and the movement of the sliding shaft 218.

One handle 219 is provided for each rotary blade 211, and similarly to the handle 119 described above, rotates by the slide of the sliding shaft 218 to change the pitch angle of each rotary blade 211 (see FIGS. 28 and 29).

In this configuration, the line of action of the pitch angle drive force is on the same line as the output shaft of the rotary drive source 212, which makes it possible to reduce the number of pitch drive sources 214 (see FIG. 26) by one, thus reducing the moment load on the pitch drive source 214 and other structures. Further, the rotary shaft 213, the output shaft of the rotary drive source 212, and the output shaft of the pitch drive source 214 are located on the same line, which provides good force transmission efficiency and is advantageous for volume reduction. Additionally, the load on the pitch drive source 214 is reduced by the rotation conversion portion 217 of a sliding screw system when air resistance is generated.

Figure 42:
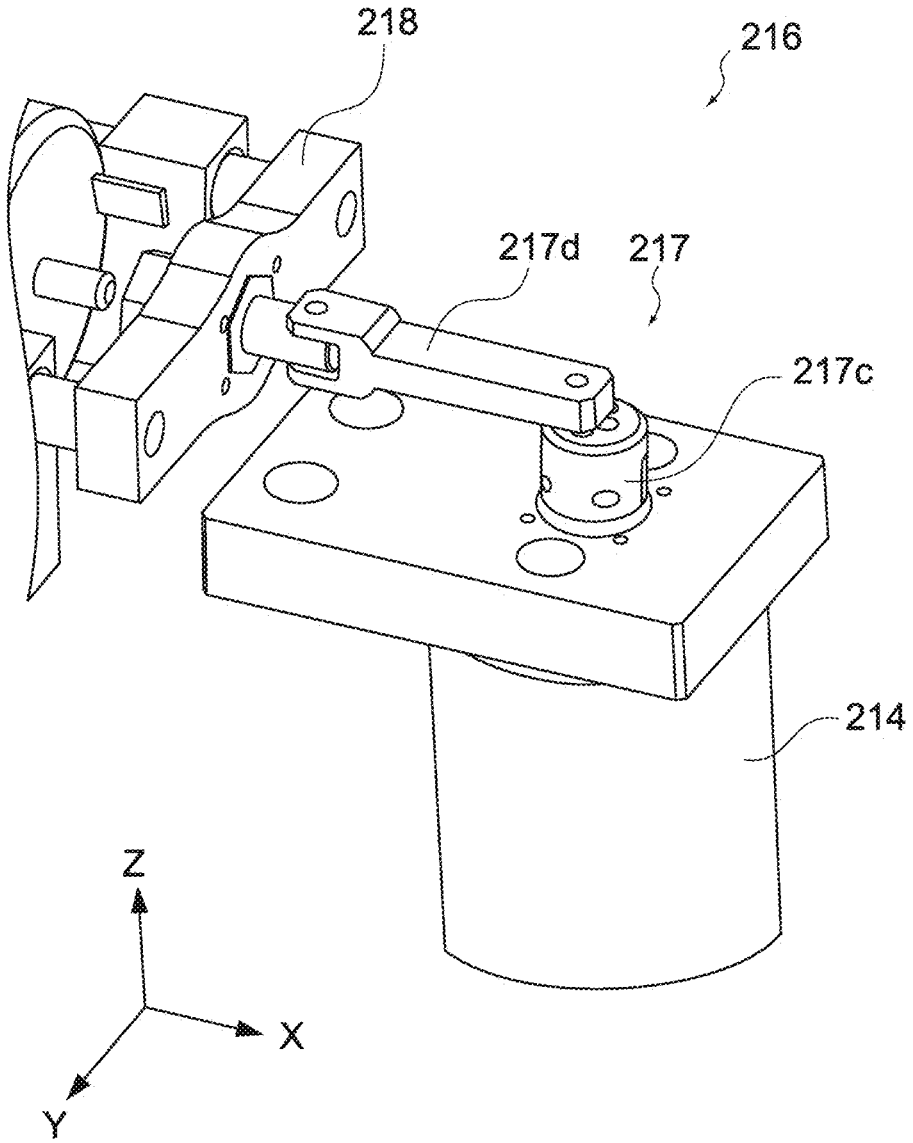
FIG. 42 is a perspective view of the vicinity of a rotation conversion portion (cam-rod system) of a fan having another configuration included in the airflow control apparatus.

Additionally, the rotation conversion portion 217 can be configured as follows. FIG. 42 is an enlarged view of the vicinity of the rotation conversion portion 217 having another configuration. As shown in the figure, the pitch drive source 214 is disposed with the output shaft in the Z direction. The rotation conversion portion 217 is of a cam-rod system and includes a rotator 217*c* and a rod 217*d*.

The rotator 217*c* is connected to the output shaft of the pitch drive source 214 and rotates with the Z direction as a rotation axis direction. The rod 217*d* is connected to the rotator 217*c* at one end and to the sliding shaft 218 at the other end. The rod 217*d* is connected to the rotator 217*c* at a position spaced away from the rotary shaft of the rotator 217*c*. When the rotator 217*c* rotates, the rod 217*d* moves the sliding shaft 218 along its axial direction (X direction).

In this configuration as well, the line of action of the pitch angle drive force is on the same line as the output shaft of the rotary drive source 212, which makes it possible to reduce the number of pitch drive sources 214 by one, thus reducing the moment load on the pitch drive source 214 and other structures. Further, the rotation conversion portion 217 has a cam-rod system, and thus a short-period motion is made possible. In this case, the pitch drive source 214 with a high rotation speed is suitable. The rotation speed of each motor becomes faster in the order of a brushless DC motor>a brushed DC motor>a step motor.

[Hardware Configuration of Control Apparatus]

Figure 43:
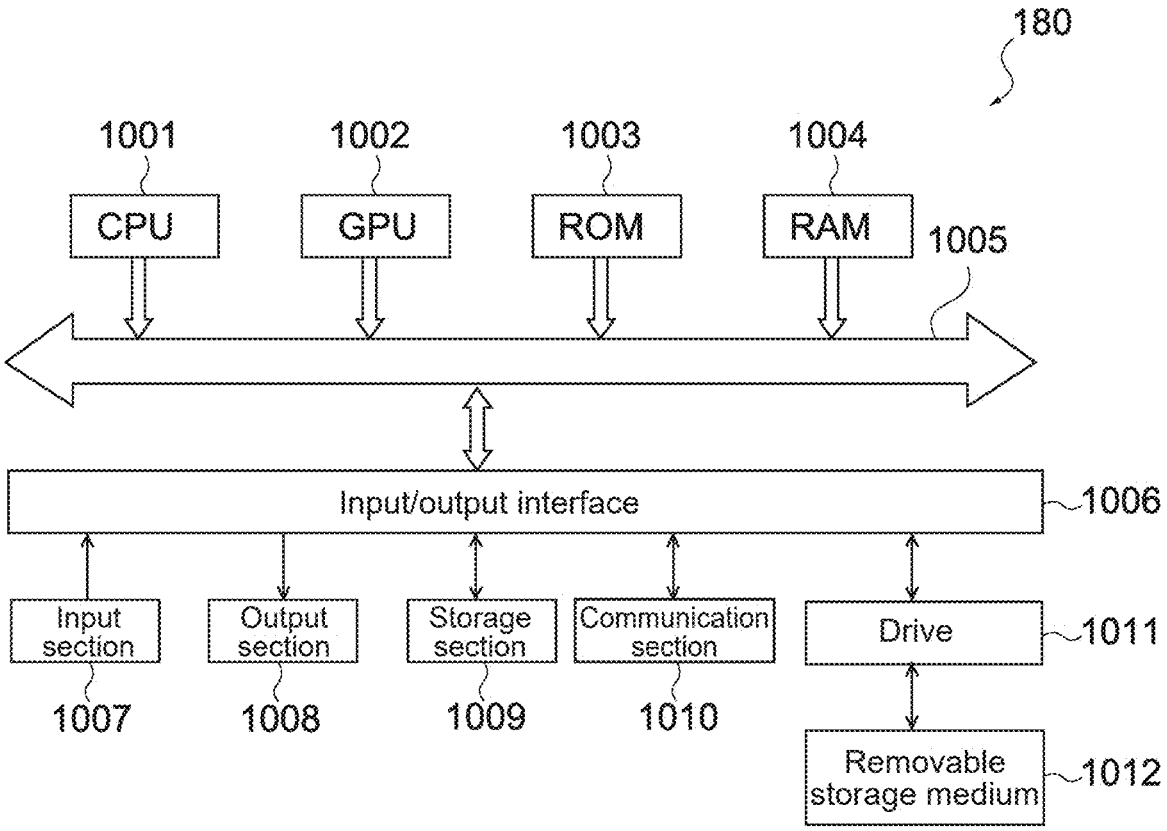
FIG. 43 is a block diagram showing a hardware configuration of a controller included in the airflow control system.

A hardware configuration that makes it possible to implement a functional configuration of the controller 180 will be described. FIG. 43 is a schematic view showing a hardware configuration of the controller 180.

As shown in the figure, the controller 180 includes a central processing unit (CPU) 1001 and a graphics processing unit (GPU) 1002. An input/output interface 1006 is connected to the CPU 1001 and the GPU 1002 via a bus 1005. A read only memory (ROM) 1003 and a random access memory (RAM) 1004 are connected to the bus 1005.

An input section 1007, an output section 1008, a storage section 1009, and a communication section 1010 are connected to the input/output interface 1006. The input section 1007 includes input devices such as a keyboard and a mouse that are used by a user to input an operation command. The output section 1008 outputs a processing operation screen and an image of a processing result to a display device. The storage section 1009 includes, for example, a hard disk drive that stores therein a program and various types of data. The communication section 1010 includes, for example, a local area network (LAN) adapter, and performs communication processing through a network as represented by the Internet. Additionally, a drive 1011 is connected to the input/output interface 1006. The drive 1011 reads data from and writes data into a removable storage medium 1012 such as a magnetic disk, an optical disc, a magneto-optical disk, or a semiconductor memory.

The CPU 1001 performs various processes in accordance with a program stored in the ROM 1003, or in accordance with a program that is read from the removable storage medium 1012 such as a magnetic disk, an optical disc, a magneto-optical disk, or a semiconductor memory to be installed on the storage section 1009, and is loaded into the RAM 1004 from the storage section 1009. Data necessary for the CPU 1001 to perform various processes is also stored in the RAM 1004 as necessary. The GPU 1002 performs calculation processing necessary to draw an image under the control of the CPU 1001.

In the controller 180 having the configuration described above, the series of processes described above is performed by the CPU 1001 loading, for example, a program stored in the storage section 1009 into the RAM 1004 and executing the program via the input/output interface 1006 and the bus 1005.

For example, the program executed by the controller 180 can be provided by being recorded in the removable storage medium 1012 serving as, for example, a package medium. Additionally, the program can be provided via a wired or wireless transmission medium such as a local area network, the Internet, or digital satellite broadcasting.

In the controller 180, the program can be installed on the storage section 1009 via the input/output interface 1006 by the removable storage medium 1012 being mounted on the drive 1011. Additionally, the program can be received by the communication section 1010 via the wired or wireless transmission medium to be installed on the storage section 1009. Moreover, the program can be installed in advance on the ROM 1003 or the storage section 1009.

Note that the program executed by the controller 180 may be a program in which processes are chronologically performed in the order of the description in the present disclosure, or may be a program in which processes are performed in parallel or a process is performed at a necessary timing such as a timing of calling. Additionally, all of the hardware configuration of the controller 180 does not have to be included in a single apparatus, and the controller 180 may include a plurality of apparatuses. Additionally, a portion of or all of the hardware configuration of the controller 180 may be included in a plurality of apparatuses connected to each other via a network.

Regarding Present Disclosure

The effects described in the present disclosure are merely examples and are not limited, and other effects may be obtained. The above description of the plurality of effects does not necessarily mean that the effects are exerted at the same time. It is meant that at least any one of the effects described above can be obtained depending on the conditions and the like, and there is a possibility that effects not described in the present disclosure can be exhibited. Additionally, at least two feature portions of the feature portions described in the present disclosure can be combined with each other.

Note that the present technology may also take the following configurations.

(1) An airflow control apparatus, including:

a first frame that is located about the center of rotation and includes a through-hole;

a second frame that is located, about the center of rotation, on an outer circumference side relative to the first frame; and a rectifying plate that is flexible, has one end fixed to the center of rotation and another end fixed to the second frame, passes through the through-hole, and changes an amount of deflection of a portion between the through-hole and the center of rotation according to a change in a length of the portion by relative rotation of the first frame and the second frame about the center of rotation.

(2) The airflow control apparatus according to (1), in which the first frame has a cylindrical shape that is centered at the center of rotation, and the second frame has a cylindrical shape that is centered at the center of rotation and has an inner diameter larger than an outer diameter of the first frame.

(3) The airflow control apparatus according to (1) or (2), in which the through-hole has a slit shape with a direction parallel to the center of rotation as a longitudinal direction, and the rectifying plate is parallel to the center of rotation.

(4) The airflow control apparatus according to (1) or (2), in which the through-hole has a slit shape with one direction as a longitudinal direction, the longitudinal direction changing between a direction parallel to the center of rotation and a direction inclined relative to the direction parallel to the center of rotation by the relative rotation, and the rectifying plate changes between a state parallel to the center of rotation and a state inclined relative to the center of rotation by the relative rotation.

(5) The airflow control apparatus according to any one of (1) to (4), further including a fan that is capable of changing a pitch angle of a rotary blade and delivers airflow to the rectifying plate.

(6) The airflow control apparatus according to (5), in which the fan includes a rotary drive source, a rotary shaft that connects the rotary blade and the rotary drive source and rotates by the rotary drive source to rotate the rotary blade, a pitch drive source, and a pitch angle changing mechanism that transmits power of the pitch drive source in a direction parallel to an axial direction of the rotary shaft separately from rotation of the rotary shaft, and changes the pitch angle of the rotary blade.

(7) The airflow control apparatus according to (6), in which the pitch angle changing mechanism includes a handle portion that changes the pitch angle of the rotary blade by rotation, and a sliding shaft that slides in a direction parallel to the rotary shaft by drive of the pitch drive source to rotate the handle portion.

(8) The airflow control apparatus according to any one of (1) to (7), further including a nozzle that is capable of changing a nozzle diameter, airflow having passed through the rectifying plate flowing into the nozzle.

(9) The airflow control apparatus according to any one of (1) to (7), further including:

a fan that is capable of changing a pitch angle of a rotary blade and delivers airflow to the rectifying plate; and a nozzle that is capable of changing a nozzle diameter, airflow having passed through the rectifying plate flowing into the nozzle.

(10) An airflow control system, including:

an airflow control apparatus including a first frame that is located about the center of rotation and includes a through-hole, a second frame that is located, about the center of rotation, on an outer circumference side relative to the first frame, and a rectifying plate that is flexible, has one end fixed to the center of rotation and another end fixed to the second frame, passes through the through-hole, and changes an amount of deflection of a portion between the through-hole and the center of rotation according to a change in a length of the portion by relative rotation of the first frame and the second frame about the center of rotation; and a controller that controls the rectifying plate to define relative rotation angles of the first frame and the second frame about the center of rotation.

(11) The airflow control system according to (10), in which the airflow control apparatus further includes a nozzle that is capable of changing a nozzle diameter, airflow having passed through the rectifying plate flowing into the nozzle, and the controller further controls the nozzle to define the nozzle diameter.

(12) The airflow control system according to (11), in which the controller changes a degree of diffusion and convergence of the airflow delivered from the airflow control apparatus by controlling the rectifying plate and the nozzle.

(13) The airflow control system according to (12), in which the controller controls the rectifying plate and the nozzle to present airflow simulated in a space in a virtual space to a user.

(14) The airflow control system according to any one of (10) to (13), in which the airflow control apparatus further includes a fan that is capable of changing a pitch angle of a rotary blade and delivers airflow to the rectifying plate, and the controller further controls the fan to define the pitch angle.

(15) The airflow control system according to (14), in which the controller changes a degree of diffusion and convergence and a flow velocity of the airflow delivered from the airflow control apparatus by controlling the rectifying plate and the fan.

(16) The airflow control system according to (15), in which the controller controls the rectifying plate and the fan to present airflow simulated in a space in a virtual space to a user.

(17) The airflow control system according to any one of (10) to (16), in which the airflow control apparatus further includes a nozzle that is capable of changing a nozzle diameter, airflow having passed through the rectifying plate flowing into the nozzle, and a fan that is capable of changing a pitch angle of a rotary blade and delivers airflow to the rectifying plate, and the controller changes a degree of diffusion and convergence and a flow velocity of the airflow delivered from the airflow control apparatus by controlling the rectifying plate, the nozzle, and the fan.

(18) The airflow control system according to (17), in which the controller controls the rectifying plate, the nozzle, and the fan to present airflow simulated in a space in a virtual space to a user.

(19) An airflow control method, including:

controlling a rectifying plate of an airflow control apparatus, the airflow control apparatus including a first frame that is located about the center of rotation and includes a through-hole, a second frame that is located, about the center of rotation, on an outer circumference side relative to the first frame, and the rectifying plate that is flexible, has one end fixed to the center of rotation and another end fixed to the second frame, passes through the through-hole, and changes an amount of deflection of a portion between the through-hole and the center of rotation according to a change in a length of the portion by relative rotation of the first frame and the second frame about the center of rotation; and defining relative rotation angles of the first frame and the second frame about the center of rotation.

(20) An airflow control method, including controlling an airflow control apparatus that generates airflow, on the basis of a flow velocity and a range of reach of airflow to be presented to a user.

REFERENCE SIGNS LIST

100 airflow control apparatus
105 pitch angle changing mechanism
110, 210 fan
111, 211 rotary blade
112, 212 rotary drive source
113, 213 rotary shaft
114, 214 pitch drive source
115, 216 pitch angle changing mechanism
116 arm
117 movable portion
118, 218 sliding shaft
119, 219 handle
120 rectifying plate unit
121 first frame
122 second frame
123 rectifying plate
130 nozzle
131 plate
151 through-hole
152 through-hole
170 airflow control system
180 control apparatus
181 airflow characteristic determination section
182 nozzle controller
183 rectifying plate controller
184 fan controller

What is claimed is:

1. An airflow control apparatus, comprising:

a first frame that is located about a center of rotation and includes a through-hole;

a second frame that is located, about the center of rotation, on an outer circumference side relative to the first frame; and a rectifying plate that is flexible, has one end fixed to the center of rotation and another end fixed to the second frame, passes through the through-hole, and changes an amount of deflection of a portion between the through-hole and the center of rotation according to a change in a length of the portion by relative rotation of the first frame and the second frame about the center of rotation.

2. The airflow control apparatus according to claim 1, wherein the first frame has a cylindrical shape that is centered at the center of rotation, and the second frame has a cylindrical shape that is centered at the center of rotation and has an inner diameter larger than an outer diameter of the first frame.

3. The airflow control apparatus according to claim 1, wherein the through-hole has a slit shape with a direction parallel to the center of rotation as a longitudinal direction, and the rectifying plate is parallel to the center of rotation.

4. The airflow control apparatus according to claim 1, wherein the through-hole has a slit shape with one direction as a longitudinal direction, the longitudinal direction changing between a direction parallel to the center of rotation and a direction inclined relative to the direction parallel to the center of rotation by the relative rotation, and the rectifying plate changes between a state parallel to the center of rotation and a state inclined relative to the center of rotation by the relative rotation.

5. The airflow control apparatus according to claim 1, further comprising a fan that is capable of changing a pitch angle of a rotary blade and delivers airflow to the rectifying plate.

6. The airflow control apparatus according to claim 5, wherein the fan includes a rotary drive source, a rotary shaft that connects the rotary blade and the rotary drive source and rotates by the rotary drive source to rotate the rotary blade, a pitch drive source, and a pitch angle changing mechanism that transmits power of the pitch drive source in a direction parallel to an axial direction of the rotary shaft separately from rotation of the rotary shaft, and changes the pitch angle of the rotary blade.

7. The airflow control apparatus according to claim 6, wherein the pitch angle changing mechanism includes a handle portion that changes the pitch angle of the rotary blade by rotation, and a sliding shaft that slides in a direction parallel to the rotary shaft by drive of the pitch drive source to rotate the handle portion.

8. The airflow control apparatus according to claim 1, further comprising a nozzle that is capable of changing a nozzle diameter, airflow having passed through the rectifying plate flowing into the nozzle.

9. The airflow control apparatus according to claim 1, further comprising:

a fan that is capable of changing a pitch angle of a rotary blade and delivers airflow to the rectifying plate; and a nozzle that is capable of changing a nozzle diameter, airflow having passed through the rectifying plate flowing into the nozzle.

10. An airflow control system, comprising:

an airflow control apparatus including a first frame that is located about a center of rotation and includes a through-hole, a second frame that is located, about the center of rotation, on an outer circumference side relative to the first frame, and a rectifying plate that is flexible, has one end fixed to the center of rotation and another end fixed to the second frame, passes through the through-hole, and changes an amount of deflection of a portion between the through-hole and the center of rotation according to a change in a length of the portion by relative rotation of the first frame and the second frame about the center of rotation; and a controller that controls the rectifying plate to define relative rotation angles of the first frame and the second frame about the center of rotation.

11. The airflow control system according to claim 10, wherein the airflow control apparatus further includes a nozzle that is capable of changing a nozzle diameter, airflow having passed through the rectifying plate flowing into the nozzle, and the controller further controls the nozzle to define the nozzle diameter.

12. The airflow control system according to claim 11, wherein the controller changes a degree of diffusion and convergence of the airflow delivered from the airflow control apparatus by controlling the rectifying plate and the nozzle.

13. The airflow control system according to claim 12, wherein the controller controls the rectifying plate and the nozzle to present airflow simulated in a space in a virtual space to a user.

14. The airflow control system according to claim 10, wherein the airflow control apparatus further includes a fan that is capable of changing a pitch angle of a rotary blade and delivers airflow to the rectifying plate, and the controller further controls the fan to define the pitch angle.

15. The airflow control system according to claim 14, wherein the controller changes a degree of diffusion and convergence and a flow velocity of the airflow delivered from the airflow control apparatus by controlling the rectifying plate and the fan.

16. The airflow control system according to claim 15, wherein the controller controls the rectifying plate and the fan to present airflow simulated in a space in a virtual space to a user.

17. The airflow control system according to claim 10, wherein the airflow control apparatus further includes a nozzle that is capable of changing a nozzle diameter, airflow having passed through the rectifying plate flowing into the nozzle, and a fan that is capable of changing a pitch angle of a rotary blade and delivers airflow to the rectifying plate, and the controller changes a degree of diffusion and convergence and a flow velocity of the airflow delivered from the airflow control apparatus by controlling the rectifying plate, the nozzle, and the fan.

18. The airflow control system according to claim 17, wherein the controller controls the rectifying plate, the nozzle, and the fan to present airflow simulated in a space in a virtual space to a user.

19. An airflow control method, comprising:

controlling a rectifying plate of an airflow control apparatus, the airflow control apparatus including a first frame that is located about a center of rotation and includes a through-hole, a second frame that is located, about the center of rotation, on an outer circumference side relative to the first frame, and the rectifying plate that is flexible, has one end fixed to the center of rotation and another end fixed to the second frame, passes through the through-hole, and changes an amount of deflection of a portion between the through-hole and the center of rotation according to a change in a length of the portion by relative rotation of the first frame and the second frame about the center of rotation; and defining relative rotation angles of the first frame and the second frame about the center of rotation.

* * * * *